US009745910B2

(12) United States Patent
Nakamura et al.

(10) Patent No.: US 9,745,910 B2
(45) Date of Patent: Aug. 29, 2017

(54) AIR FUEL RATIO CONTROLLING APPARATUS

(75) Inventors: Masanori Nakamura, Wako (JP); Yukihiro Asada, Wako (JP); Shiro Kokubu, Wako (JP); Emi Shida, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 1448 days.

(21) Appl. No.: 13/429,796

(22) Filed: Mar. 26, 2012

(65) Prior Publication Data

US 2012/0253643 A1 Oct. 4, 2012

(30) Foreign Application Priority Data

Mar. 31, 2011 (JP) ..... 2011-081244

(51) Int. Cl.
*F02D 41/14* (2006.01)
*F02D 41/30* (2006.01)

(52) U.S. Cl.
CPC ..... *F02D 41/1402* (2013.01); *F02D 41/1403* (2013.01); *F02D 41/1439* (2013.01); *F02D 41/1454* (2013.01); *F02D 41/1458* (2013.01); *F02D 2041/142* (2013.01); *F02D 2041/1412* (2013.01); *F02D 2041/1433* (2013.01)

(58) Field of Classification Search
CPC ..... F02D 2041/142; F02D 2041/1409; F02D 2041/1412; F02D 2041/1416; F02D 2041/1418; F02D 2041/1433; F02D 41/1402; F02D 41/1403; F02D 41/1454–41/1458; Y02T 10/47
USPC ..... 701/103, 104, 109; 123/672, 673, 674, 123/681, 683, 684, 687, 690; 60/276, 60/285
See application file for complete search history.

(56) References Cited

U.S. PATENT DOCUMENTS

| | | | | |
|---|---|---|---|---|
| 5,617,836 | A * | 4/1997 | Cullen et al. | 123/674 |
| 5,657,737 | A * | 8/1997 | Ishida et al. | 123/674 |
| 5,878,733 | A * | 3/1999 | Kato et al. | 123/681 |
| 5,911,682 | A * | 6/1999 | Kato et al. | 60/276 |
| 5,915,359 | A * | 6/1999 | Meyer et al. | 123/436 |
| 5,915,368 | A * | 6/1999 | Ishida et al. | 123/675 |
| 5,924,281 | A * | 7/1999 | Yasui et al. | 60/276 |
| 6,029,641 | A * | 2/2000 | Suzuki et al. | 123/673 |
| 6,073,073 | A * | 6/2000 | Kitamura et al. | 701/103 |
| 6,125,831 | A * | 10/2000 | Yasui et al. | 123/674 |

(Continued)

FOREIGN PATENT DOCUMENTS

JP 3373724 B2 2/2003

*Primary Examiner* — Mahmoud Gimie
*Assistant Examiner* — John Zaleskas
(74) *Attorney, Agent, or Firm* — Squire Patton Boggs (US) LLP

(57) ABSTRACT

An air feed ratio controlling apparatus can include a predictor for predicting an air fuel ratio on the downstream side of a catalyst calculates a predicted air fuel ratio at least based on an actual air fuel ratio from an oxygen sensor and a history of a first correction coefficient. The air fuel ratio controlling apparatus can also include an adaptive model corrector which determines the deviation between the actual air fuel ratio and the predicted air fuel ratio as a prediction error ERPRE, and superposes a second correction coefficient on the first correction coefficient so that the prediction error may be reduced to zero.

17 Claims, 17 Drawing Sheets

(56) References Cited

U.S. PATENT DOCUMENTS

| | | | | |
|---|---|---|---|---|
| 6,188,953 | B1 * | 2/2001 | Yasui et al. | 701/109 |
| 6,195,988 | B1 * | 3/2001 | Yasui et al. | 60/285 |
| 6,233,922 | B1 * | 5/2001 | Maloney | 60/276 |
| 6,266,605 | B1 * | 7/2001 | Yasui et al. | 701/109 |
| 6,276,341 | B1 * | 8/2001 | Takahashi et al. | 123/492 |
| 6,292,739 | B1 * | 9/2001 | Yasui et al. | 701/109 |
| 6,351,943 | B1 * | 3/2002 | Tagami et al. | 60/285 |
| 6,370,473 | B1 * | 4/2002 | Yasui et al. | 701/109 |
| 6,449,943 | B1 * | 9/2002 | Ueno et al. | 60/274 |
| 6,449,944 | B1 * | 9/2002 | Yasui et al. | 60/277 |
| 6,453,229 | B1 * | 9/2002 | Ohkuma et al. | 701/109 |
| 6,684,150 | B2 * | 1/2004 | Yasui et al. | 701/106 |
| 6,698,186 | B2 * | 3/2004 | Ueno et al. | 60/277 |
| 6,711,891 | B2 * | 3/2004 | Kitamura et al. | 60/276 |
| 6,760,657 | B2 * | 7/2004 | Katoh | 701/104 |
| 6,785,601 | B2 * | 8/2004 | Yoshizawa et al. | 701/109 |
| 7,051,725 | B2 * | 5/2006 | Ikemoto et al. | 123/673 |
| 2006/0260592 | A1 * | 11/2006 | Rosel et al. | 123/673 |
| 2007/0028906 | A1 * | 2/2007 | Kato et al. | 123/692 |
| 2008/0072878 | A1 * | 3/2008 | Kokubu | 123/486 |
| 2009/0266054 | A1 * | 10/2009 | Iihoshi et al. | 60/277 |

* cited by examiner

AIR FUEL RATIO CONTROLLING APPARATUS

BACKGROUND

Field

The present invention relates to an air fuel ratio controlling apparatus, and particularly to an air fuel ratio controlling apparatus suitable for use with, for example, a vehicle such as a motorcycle or the like which includes an internal combustion engine therein.

Description of the Related Art

For example, in a system wherein exhaust gas of an internal combustion engine of an automobile or the like is purified by a catalytic apparatus and then discharged, it is desired from a point of view of environmental protection that the air fuel ratio of exhaust gas of the engine be controlled to a suitable air fuel ratio so that a good exhaust gas purification capacity may be exhibited.

As a technique for carrying out such air fuel ratio control as described above, for example, an air fuel ratio controlling apparatus disclosed in Patent Document 1 (Japanese Patent Number 3373724) is available.

Patent Document 1 discloses an air fuel ratio controlling apparatus configured such that, in order to cancel a displacement of a fuel injection amount calculated from a fuel injection amount map (in which an engine speed, a throttle opening, a negative pressure and so forth are used as parameters) for determining a fuel injection amount of the engine from a target air fuel ratio, a correction coefficient is superposed on the fuel injection amount.

In particular, a LAF sensor which converts an oxygen concentration or air fuel ratio of exhaust gas into a signal having a level which increases in proportion to the oxygen concentration over a wide range of the oxygen concentration is installed on the upstream of a catalytic apparatus or purifier disposed in an exhaust pipe of the engine while an oxygen sensor/air fuel ratio sensor is provided on the downstream of the catalytic apparatus. Then, a predicted value of the air fuel ratio after the catalyst is calculated using a detected value of the LAF sensor and a correction coefficient is determined, for example, by a sliding mode controller using the predicted value.

Since the LAF sensor is expensive, there is a desire to eliminate the LAF sensor provided on the upstream of the catalytic apparatus to reduce the cost of the system or from a reason that there is a restriction to the disposition space in a motorcycle or the like.

However, since an output value (SVO2) of the oxygen sensor which is a target value of the emission is converged to a target value based on the output value (SVO2) which is an input value to a sliding mode controller (SMC) which models intake and exhaust of the engine, where the LAF sensor is not installed on the upstream of the catalytic apparatus, the air fuel ratio before the catalyst cannot be measured. Therefore, the tolerance and the time-dependent variation of the engine and prediction of an injection error or the like of a fuel injection valve in the model of the engine cannot be monitored, and there is the possibility that the prediction range of the predicted value for the output value (SVO2) may be expanded and much time may be required for the convergence to the target value by the sliding mode controller (SMC).

Further, since there is a restriction in adjustment also to the convergence gain of the sliding mode controller (SMC), a prediction error of a predicted value of the output value (SVO2) may not be eliminated and the output value (SVO2) may not be able to be converged to the target value.

SUMMARY

The present invention has been made in view of such a subject as described above, and it is an object of the present invention to provide an air fuel ratio controlling apparatus in which, even if a LAF sensor is not installed on the upstream side of a catalytic apparatus, optimization of the air fuel ratio can be achieved and reduction of the cost of the system and application of air fuel ratio control to a motorcycle or the like can be promoted.

An air fuel ratio controlling apparatus according to an embodiment of the present invention includes a basic fuel injection map adapted to determine a fuel injection amount for an engine at least based on parameters of an engine speed. A throttle opening and an intake air pressure. An air fuel ratio detection unit is provided on the downstream of a catalyst disposed in an exhaust pipe of the engine, and is configured to detect an air fuel ratio. An air fuel ratio prediction unit is configured to predict an air fuel ratio on the downstream side of the catalyst. A correction coefficient calculation unit is configured to determine a correction coefficient with respect to the fuel injection amount based on the predicted air fuel ratio from the air fuel ratio prediction unit. The air fuel ratio prediction unit is also configured to calculate the predicted air fuel ratio at least based on an actual air fuel ratio from the air fuel ratio detection unit and a history of the correction coefficient. The air fuel ratio controlling apparatus further includes an adaptive model correction unit configured to determine a deviation between the actual air fuel ratio and the predicted air fuel ratio predicted in the past corresponding to the actual air fuel ratio as a prediction error, and superposing a second correction coefficient on the correction coefficient so that the prediction error may be reduced to zero.

In certain embodiments, the air fuel ratio controlling apparatus further includes a control section adapted to control at least the correction coefficient calculation unit and the adaptive model correction. The adaptive model correction unit includes a prediction accuracy decision unit configured to decide prediction accuracy based on the prediction error. The control section temporarily stops processing by the correction coefficient calculation unit at a stage at which deterioration of the prediction accuracy is decided by the prediction accuracy decision unit, and shortens a starting period of the adaptive model correction unit during the stopping.

In certain embodiments, at a stage at which deterioration of the prediction accuracy is decided by the prediction accuracy decision unit, feedback is carried out so that an error between the actual air fuel ratio and a target value set in advance may be reduced to zero without using the air fuel ratio prediction unit.

In certain embodiments, at a stage at which it is decided by the prediction accuracy decision unit that the prediction accuracy is assured, the control section (126) returns the starting period of the adaptive model correction unit to the original period, and cancels the temporary stopping of the correction coefficient calculation unit.

In certain embodiments the air fuel ratio controlling apparatus further includes a control section adapted to control at least the correction coefficient calculation unit. The adaptive model correction unit includes prediction accuracy decision unit configured to decide prediction accuracy based on the prediction error. At a stage at which deterioration of the prediction accuracy is decided by the prediction accuracy decision unit, the control section causes the correction coefficient calculation unit to carry out feedback so that an error between the actual air fuel ratio and a target value set in advance may be reduced to zero.

In other embodiments, the air fuel ratio controlling apparatus further includes a control section adapted to control at least the correction coefficient calculation unit and the adaptive model correction means. The control section temporarily stops processing by the correction coefficient calculation unit for time set in advance based on an input of a signal (Se) indicating that an air fuel ratio feedback condition is satisfied, and shortens a starting period of the adaptive model correction unit during the stopping.

In other embodiments, based on the input of the signal (Se) indicating that the air fuel ratio feedback condition is satisfied, feedback is carried out so that an error between the actual air fuel ratio and a target value set in advance may be reduced to zero without using the air fuel ratio prediction means.

In certain embodiments, at a stage at which time set in advance elapses, the control section returns the starting period of the adaptive model correction means to the original period, and cancels the temporary stopping of the correction coefficient calculation unit.

In certain embodiments, the air fuel ratio controlling apparatus further includes a control section adapted to control at least the correction coefficient calculation unit. The control section (126) causes the correction coefficient calculation unit to carry out feedback for time set in advance based on an input of a signal indicating that an air fuel ratio feedback condition is satisfied so that an error between the actual air fuel ratio and a target value set in advance may be reduced to zero.

In certain embodiments, the air fuel ratio controlling apparatus further includes a feedback unit configured to be used to carry out feedback so that an error between the actual air fuel ratio and a target value set in advance may be reduced to zero.

In certain embodiments, the feedback unit is a sliding mode controlling unit or PID controlling unit.

In certain embodiments, the correction coefficient calculating unit is a sliding mode controlling unit configured to carry out feedback of the correction coefficient so that an error of the predicted air fuel ratio may be reduced to zero, and the control section temporarily stops the controlling operation by the sliding mode controlling unit, and temporarily stops an identifier for identifying a parameter of the sliding mode controlling unit.

In certain embodiments, the correction coefficient calculation unit is a sliding mode controlling unit configured to carry out feedback of the correction coefficient so that an error of the predicted air fuel ratio may be reduced to zero. The control section returns the starting period of the adaptive model correction unit to the original period, cancels the temporary stopping of the sliding mode controlling unit, and then resets a parameter of an identifier for identifying a parameter of the sliding mode controlling unit to an initial value.

In certain embodiments the basic fuel injection map includes a first basic fuel injection map based on an engine speed and a throttle opening, and a second basic fuel injection map based on the engine speed and an intake air pressure. The air fuel ratio controlling apparatus further includes map selection unit configured to select a basic fuel injection map to be used based on the engine speed and the throttle opening from between the first basic fuel injection map and the second basic fuel injection map. The first basic fuel injection map is selected by the map selection. The adaptive model correction unit is configured to carry out feedback of a prediction error correction amount (θthIJ) so that the prediction error on which a weight component based on the engine speed and the throttle opening is reflected may be reduced to zero in a fixed time period, and to calculate the second correction coefficient based on the prediction error correction amount at a predetermined timing.

In certain embodiments, the adaptive model correction unit can include a weighting unit configured to superposing a first weight component on which sensitivity with respect to an air fuel ratio of the air fuel ratio detection unit is reflected, a second weight component on which a variation of a value of the first basic fuel injection map with respect to a variation of the engine speed and the throttle opening is reflected and third weight components corresponding to a plurality of regions obtained by segmenting the first basic fuel injection map based on the engine speed and the throttle opening, on the prediction error within the fixed time period to obtain correction model errors corresponding to the plural regions. A feedback unit is configured to carry out feedback of the prediction error correction amounts corresponding to the plural regions so that such correction model errors corresponding to the plural regions may be reduced to zero in the fixed time period. for a superposing unit is configured to superpose the third weight components corresponding to the plural regions on the prediction error correction amounts corresponding to the plural regions at the predetermined timing to calculate correction coefficients corresponding to the plural regions and to add all of the correction coefficients to calculate the second correction coefficient.

In certain embodiments, the basic fuel injection map includes a first basic fuel injection map based on an engine speed and a throttle opening, and a second basic fuel injection map based on the engine speed and an intake air pressure. The air fuel ratio controlling apparatus can further include a map selection unit which is configured to select a basic fuel injection map to be used based on the engine speed and the throttle opening from between the first basic fuel injection map and the second basic fuel injection map. The second basic fuel injection map is selected by the map selection unit. The adaptive model correction unit is configured to carry out feedback of a prediction error correction amount so that the prediction error on which a weight component based on the engine speed and the intake air pressure is reflected may be reduced to zero within a fixed time period, and to calculate the second correction coefficient (KTIMB) based on the prediction error correction amount at a predetermined timing.

In certain embodiments, the adaptive model correction unit includes a weighting unit configured to superpose a first weight component on which sensitivity with respect to an air fuel ratio of the air fuel ratio detection means is reflected, a second weight component on which a variation of a value of the second basic fuel injection map with respect to a variation of the engine speed and the intake air pressure is reflected, and third weight components corresponding to a plurality of regions obtained by segmenting the second basic fuel injection map based on the engine speed and the intake air pressure, on the prediction error within the fixed time period to obtain correction model errors corresponding to the plural regions. A feedback unit is configured to carry out feedback of the prediction error correction amounts corresponding to the plural regions so that such correction model errors corresponding to the plural regions may be reduced to zero in the fixed time period. A superposing unit is configured to superpose the third weight components corresponding to the plural regions on the prediction error correction amounts corresponding to the plural regions at the predetermined timing to calculate correction coefficients corresponding to the plural regions and to add all of the correction coefficients to calculate the second correction coefficient With embodiments of the present invention, even if a LAF sensor which has been provided on the upstream of the catalytic apparatus is eliminated, since the second correction coefficient is produced by the adaptive model correction unit so that the deviation between the actual air fuel ratio and the predicted air fuel ratio predicted in the past by the air fuel ratio prediction means corresponding to the actual air fuel ratio may be reduced to zero, the likelihood of the predicted value of the output value of the oxygen sensor can be improved without using the LAF sensor. Therefore, the predicted value of the output value can be quickly converged to the target value by the correction coefficient calculation unit without expanding the prediction range of the predicted value of the output value. Consequently, optimization of the air fuel ratio on the downstream of the catalytic apparatus can be achieved. Accordingly, since the LAF sensor can be omitted, a harness relating to the LAF sensor and an interface circuit for the ECU can be omitted, and reduction of the cost of the system, reduction of the disposition space and so forth can be achieved. Further, the air fuel ratio controlling apparatus can be easily applied also to a vehicle whose disposition space is restricted such as a motorcycle or the like.

In certain embodiments, the processing by the correction coefficient calculation unit is temporarily stopped at a stage at which deterioration of the prediction accuracy is decided and the starting period of the adaptive model correction means is shortened during the stopping. Therefore, the time until the prediction error is converged to zero can be decreased.

In certain embodiments, at a stage at which deterioration of the prediction accuracy is decided, feedback is carried out so that the error between the actual air fuel ratio and the target value set in advance may be reduced to zero without using the air fuel ratio prediction unit. Therefore, the time until the prediction accuracy is assured can be shortened in comparison with a case in which the air fuel ratio prediction unit is used.

In some embodiments, at a stage at which it is decided that the prediction accuracy is assured, the starting period of the adaptive model correction unit is returned to the original period and the temporary stopping of the correction coefficient calculation unit is cancelled. Therefore, production of the first correction coefficient by the correction coefficient calculation unit is re-started at a stage at which the prediction accuracy is assured. Therefore, the prediction accuracy is further improved and optimization of the air fuel ratio on the downstream of the catalytic apparatus can be hastened.

In certain embodiments, at a stage at which deterioration of the prediction accuracy is decided, feedback is carried out by the correction coefficient calculation unit so that the error between the actual air fuel ratio and the target value set in advance may be reduced to zero. Therefore, a feedback device for exclusive use is not required, and simplification of the configuration can be achieved.

In certain embodiments, the processing by the correction coefficient calculation unit is temporarily stopped for the time set in advance based on the input of the signal which indicates that an air fuel ratio feedback condition is satisfied and the starting period of the adaptive model correction means is shortened during the stopping. Therefore, also where a prediction error appears from a driving condition or the like before the air fuel ratio feedback condition is satisfied, the prediction error can be cancelled at an initial stage from a point of time at which the air fuel ratio feedback condition is satisfied.

In certain embodiments, since feedback is carried out so that the error between the actual air fuel ratio and the target value set in advance may be reduced to zero, without using the air fuel ratio prediction unit, based on an input of the signal which indicates that the air fuel ratio feedback condition is satisfied, also where a prediction error appears from a driving condition or the like before the air fuel ratio feedback condition is satisfied, the prediction error can be cancelled at an initial stage from a point of time at which the air fuel ratio feedback condition is satisfied.

In some embodiments, at a stage at which time (predetermined time) set in advance elapses after deterioration of the prediction accuracy is decided, the starting period of the adaptive model correction unit is returned to the original period and the temporary stopping of the correction coefficient calculation means is cancelled. Therefore, after one or more cycles of the predetermined time elapse, production of the first correction coefficient by the correction coefficient calculation unit is re-started at a stage at which the prediction accuracy is assured. Therefore, the prediction accuracy is further improved and optimization of the air fuel ratio downstream of the catalytic apparatus can be hastened. By setting one cycle of the predetermined time to a period of time in which it is expected that the prediction accuracy is assured, the prediction accuracy is assured at a point of time at which two cycles of predetermined time elapse at the most.

In some embodiments, feedback is carried out by the correction coefficient calculation unit for the time set in advance so that the error between the actual air fuel ratio and the target value set in advance may be reduced to zero based on an input of the signal which indicates that the air fuel ratio feedback condition is satisfied. Therefore, a feedback device for exclusive use is not required and simplification of the configuration can be achieved.

In certain embodiments, feedback is carried out by the feedback unit for exclusive use so that the error between the actual air fuel ratio and the target value set in advance may be reduced to zero. Therefore, the processing by the correction coefficient calculation means can be temporarily stopped. Consequently, the starting period of the adaptive model correction unit can be shortened and the time until the prediction error is converged to zero can be reduced.

In certain embodiments, the sliding mode controlling unit or the PID controlling unit is used as the feedback unit for exclusive use for carrying out feedback so that the error between the actual air fuel ratio and the target value set in advance may be reduced to zero. Therefore, the prediction accuracy can be assured at an early stage. Particularly, if the PID controlling unit is used, then time until the prediction accuracy is assured can be reduced still more.

In some embodiments, at a stage at which deterioration of the prediction accuracy is decided or based on an input of the signal which indicates that the air fuel ratio feedback condition is satisfied, the controlling operation by the sliding mode controlling unit is temporarily stopped and the identifier for identifying a parameter of the sliding mode controlling unit is temporarily stopped. Therefore, the starting period of the adaptive model correction unit can be shortened and the time until the prediction error is converged to zero can be reduced.

In certain embodiments, at a stage at which it is decided that the prediction accuracy is assured or at a stage at which the time set in advance elapses from a point of time at which the signal indicating that the air fuel ratio feedback condition is satisfied is inputted, the starting period of the adaptive model correction unit is returned to the original period, the temporary stopping of the sliding mode controlling unit is cancelled, and then a parameter of the identifier for identifying the parameter of the sliding mode controlling unit is reset to an initial value. Therefore, by using the initial value without using an identification parameter when the prediction accuracy is deteriorated as an identification parameter when the prediction accuracy is assured or at a stage at which it is expected that the prediction accuracy is assured, the assurance of the prediction accuracy can be maintained and optimization of the air fuel ratio on the downstream of the catalytic apparatus can be hastened.

In some embodiments, by the adaptive model correction unit, feedback of the prediction error correction amount is carried out so that the prediction error on which the weight component based on the engine speed and the throttle opening with respect to the first basic fuel injection map to be used is reflected may be reduced to zero within the fixed time period, and the second correction coefficient is calculated based on the prediction error correction amount at a predetermined timing. Therefore, even if the LAF sensor provided on the upstream of the catalytic apparatus is eliminated, optimization of the air fuel ratio on the downstream of the catalytic apparatus can be achieved.

In some embodiments, feedback of the prediction error correction amounts corresponding to the plural regions obtained by segmenting the first basic fuel injection map based on the engine speed and the throttle opening is carried out in the fixed time period so that correction model errors corresponding to the plural regions may be reduced to zero. Then, correction coefficients corresponding to the plural regions are calculated based on the prediction error correction amounts corresponding to the plural regions at a predetermined timing and then all of the correction coefficients are added to calculate the second correction coefficient. Therefore, the second correction coefficient has a value for correcting a map value to be used with the correction coefficients of the plural regions so that the prediction error may be reduced to zero. Accordingly, by superposing the second correction coefficient having such a characteristic as described above on the first correction coefficient, optimization of the air fuel ratio on the downstream of the catalytic apparatus can be achieved.

Particularly, the first weight component on which the sensitivity with respect to the air fuel ratio of the air fuel ratio detection unit is reflected, the second weight component on which the variation of a value of the first basic fuel injection map with respect to the variation of the engine speed and the throttle opening is reflected and the third weight components which correspond to the plural regions obtained by segmenting the first basic fuel injection map based on the engine speed and the throttle opening are superposed on the prediction error to determine the correction model error. Therefore, optimization of the air fuel ratio on the downstream of the catalytic apparatus can be carried out with high accuracy.

In certain embodiments, feedback of the prediction error correction amount is carried out by the adaptive model correction unit so that the prediction error on which the weight component based on the engine speed and the intake air pressure with respect to the second basic fuel injection map to be used is reflected may be reduced to zero in the fixed time period. Further, the second correction coefficient is calculated based on the prediction error correction amount at a predetermined timing. Therefore, even if the LAF sensor provided on the upstream of the catalytic apparatus is eliminated, optimization of the air fuel ratio on the downstream of the catalytic apparatus can be achieved.

In some embodiments, feedback of the prediction error correction amounts corresponding to the plural regions obtained by segmenting the second basic fuel injection map based on the engine speed and the intake air pressure is carried out so that the correction model errors corresponding to the plural regions may be reduced to zero in the fixed time period. Then, correction coefficients corresponding to the plural regions are calculated based on the prediction error correction amounts corresponding to the plural regions at a predetermined timing, and then all of the correction coefficients are added to calculate the second correction coefficient. Therefore, the second correction coefficient has a value for correcting a map value to be used with the correction coefficients of the plural regions so that the prediction error may be reduced to zero. Accordingly, by superposing the second correction coefficient having such a characteristic as described above on the first correction coefficient, optimization of the air fuel ratio on the downstream of the catalytic apparatus can be achieved.

Particularly, the first weight component on which the sensitivity with respect to the air fuel ratio of the air fuel ratio detection unit is reflected, the second weight component on which the variation of the value of the second basic fuel injection map with respect to the variation of the engine speed and the intake air pressure is reflected and the third weight components which correspond to the plural regions obtained by segmenting the second basic fuel injection map based on the engine speed and the intake air pressure are superposed on the prediction error to determine the correction model error. Therefore, optimization of the air fuel ratio on the downstream of the catalytic apparatus can be carried out with high accuracy.

DETAILED DESCRIPTION

In the following, an example of an embodiment wherein an air fuel ratio controlling apparatus according to the present invention is applied, for example, to a motorcycle is described with reference to FIGS. 1 to 17.

A vehicle such as motorcycle 12 in which the air fuel ratio controlling apparatus 10 according to an embodiment is incorporated is described with reference to FIG. 1.

Figure 1:
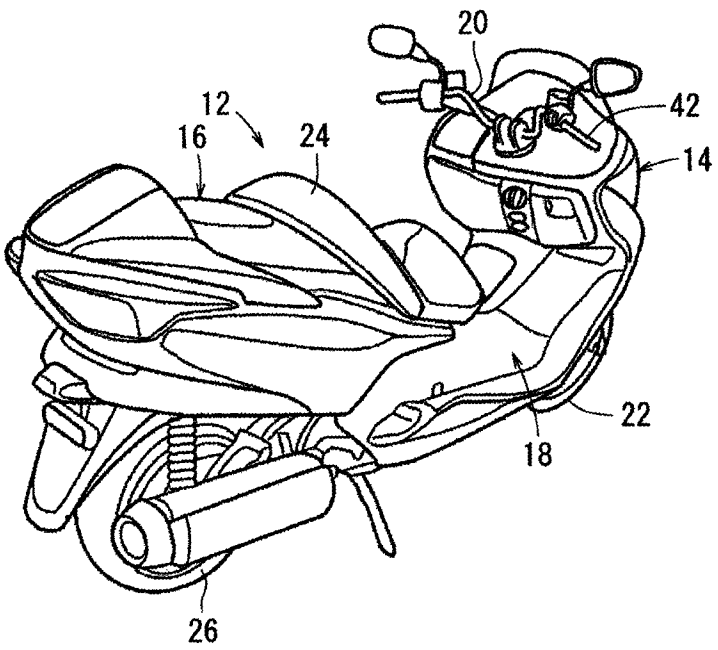
FIG. 1 is a perspective view showing an example of a motorcycle on which an air fuel ratio controlling apparatus according to an embodiment is provided.

As shown in FIG. 1, the motorcycle 12 is configured from a vehicle body front portion 14 and a vehicle body rear portion 16 connected to each other through a low floor section 18. The vehicle body front portion 14 has a handle bar 20 attached for rotation to an upper portion thereof and has a front wheel 22 supported for rotation at a lower portion thereof. The vehicle body rear portion 16 has a seat 24 attached to an upper portion thereof and has a rear wheel 26 supported for rotation at a lower portion thereof.

Figure 2:
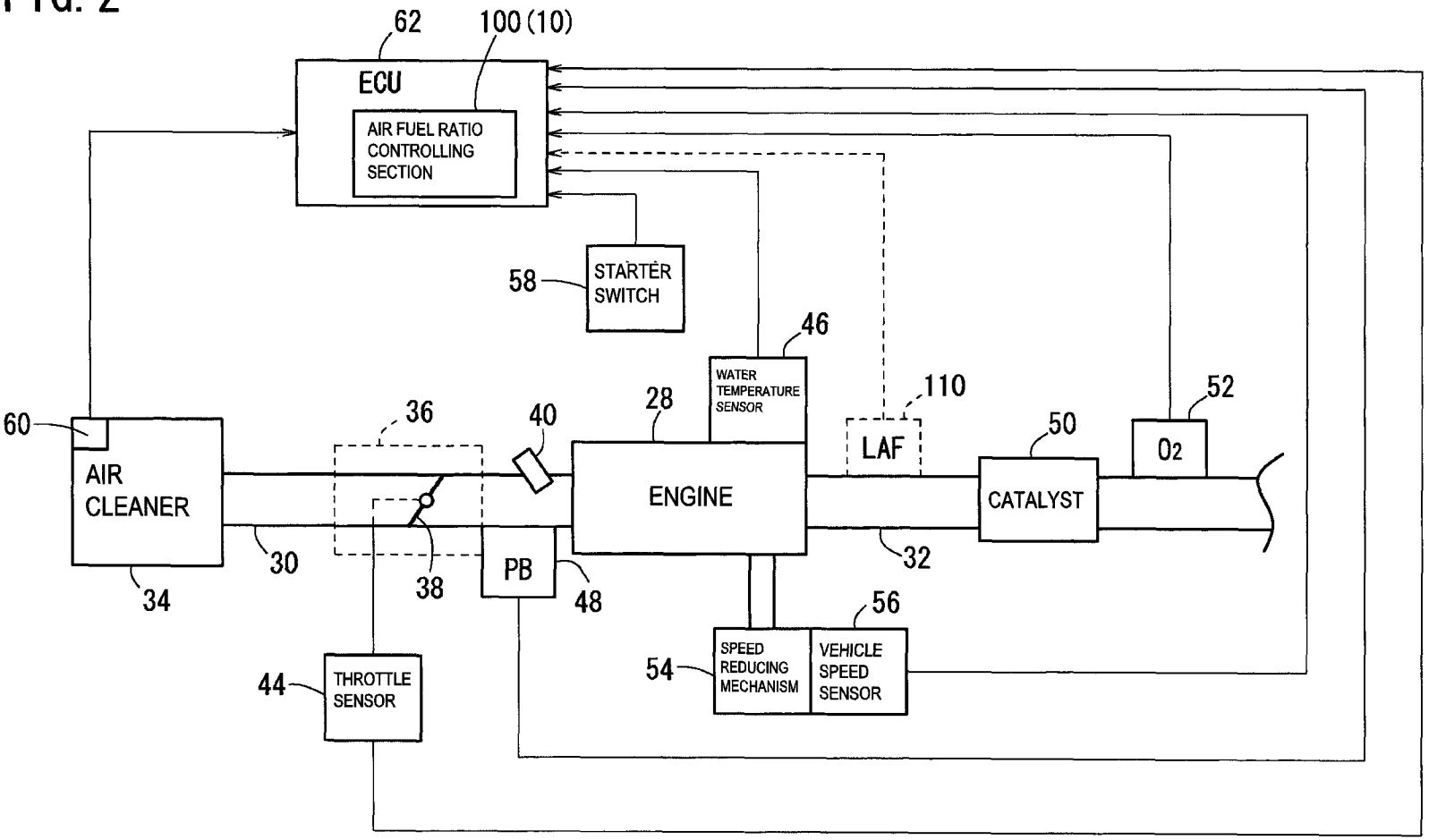
FIG. 2 is a block diagram showing an example of a control system of an engine of the motorcycle.

An intake pipe 30 and an exhaust pipe 32 are provided for an engine 28 of the motorcycle 12 as schematically shown in FIG. 2, and the intake pipe 30 is connected between the engine 28 and an air cleaner 34. A throttle valve 38 is provided in a throttle body 36 provided for the intake pipe 30. A fuel injection valve is provided between the engine 28 and the throttle body 36 in the intake pipe 30.

The throttle valve 38 is pivoted in response to a turning operation of a throttle grip 42 (refer to FIG. 1), and the amount of the pivotal motion (opening of the throttle valve 38) is detected by a throttle sensor 44. The amount of air to be supplied to the engine 28 is varied by opening or closing the throttle valve 38 in response to an operation of the throttle grip 42 by a driver.

A water temperature sensor 46 for detecting the temperature of engine cooling water is provided for the engine 28, and a PB sensor 48 for detecting an intake air pressure (intake air negative pressure) is provided for the intake pipe 30. An oxygen sensor (air fuel ratio detection means) 52 for detecting the air fuel ratio on the downstream side of a catalytic apparatus 50 is provided on the downstream of the catalytic apparatus installed in the exhaust pipe of the engine 28. The oxygen concentration detected by the oxygen sensor 52 corresponds to an actual air fuel ratio of exhaust gas after it passes through the catalytic apparatus 50. Further, a vehicle speed sensor 56 for detecting the vehicle speed from the number of rotations of an output gear wheel of a speed reducing mechanism 54 is provided for the engine 28. A starter switch 58 is a switch for starting up the engine 28 in response to a manipulation of an ignition key. Further, an atmospheric pressure sensor 60 is provided at a position far away from the intake pipe 30 of the air cleaner 34.

An engine controlling apparatus or engine control unit (ECU) 62 has an air fuel ratio controlling section 100 which functions as the air fuel ratio controlling apparatus 10 according to the present embodiment.

Figure 3:
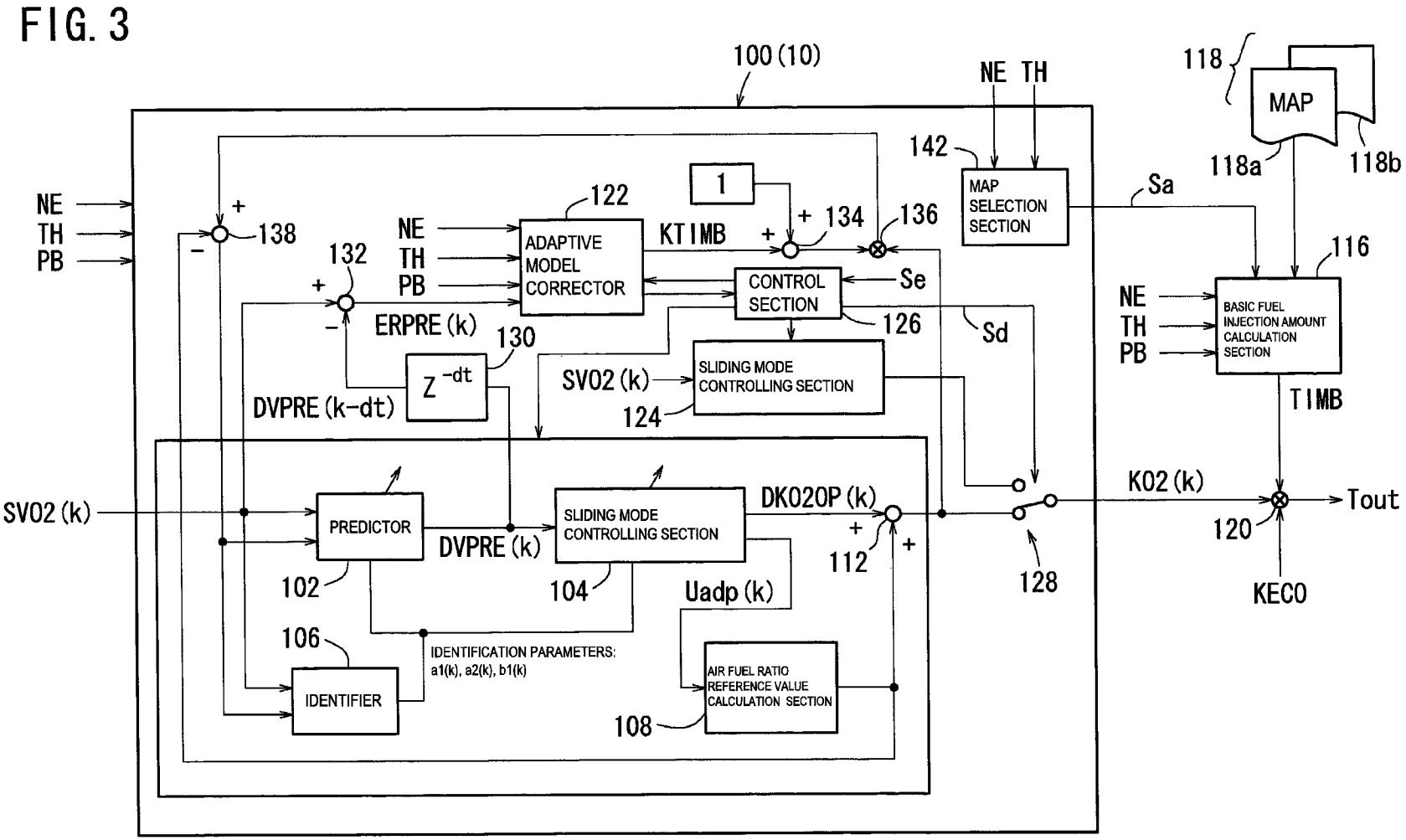
FIG. 3 is a controlling block diagram showing a configuration of the air fuel ratio controlling apparatus (air fuel ratio controlling section) according to the present embodiment.

As shown in FIG. 3, the air fuel ratio controlling section 100 includes a predictor 102 acting as an air fuel ratio prediction unit or means for predicting the air fuel ratio on the downstream side of the catalytic apparatus 50, a first sliding mode controlling section or correction coefficient calculation means 104 for determining a first correction coefficient DKO3OP(k) for the fuel injection amount based on a predicted air fuel ratio DVPRE from the predictor 102, an identifier 106 for identifying parameters for the first sliding mode controlling section 104 and the predictor 102, and an air fuel ratio reference value calculation section 108 for calculating an air fuel ratio reference value.

Figure 4:
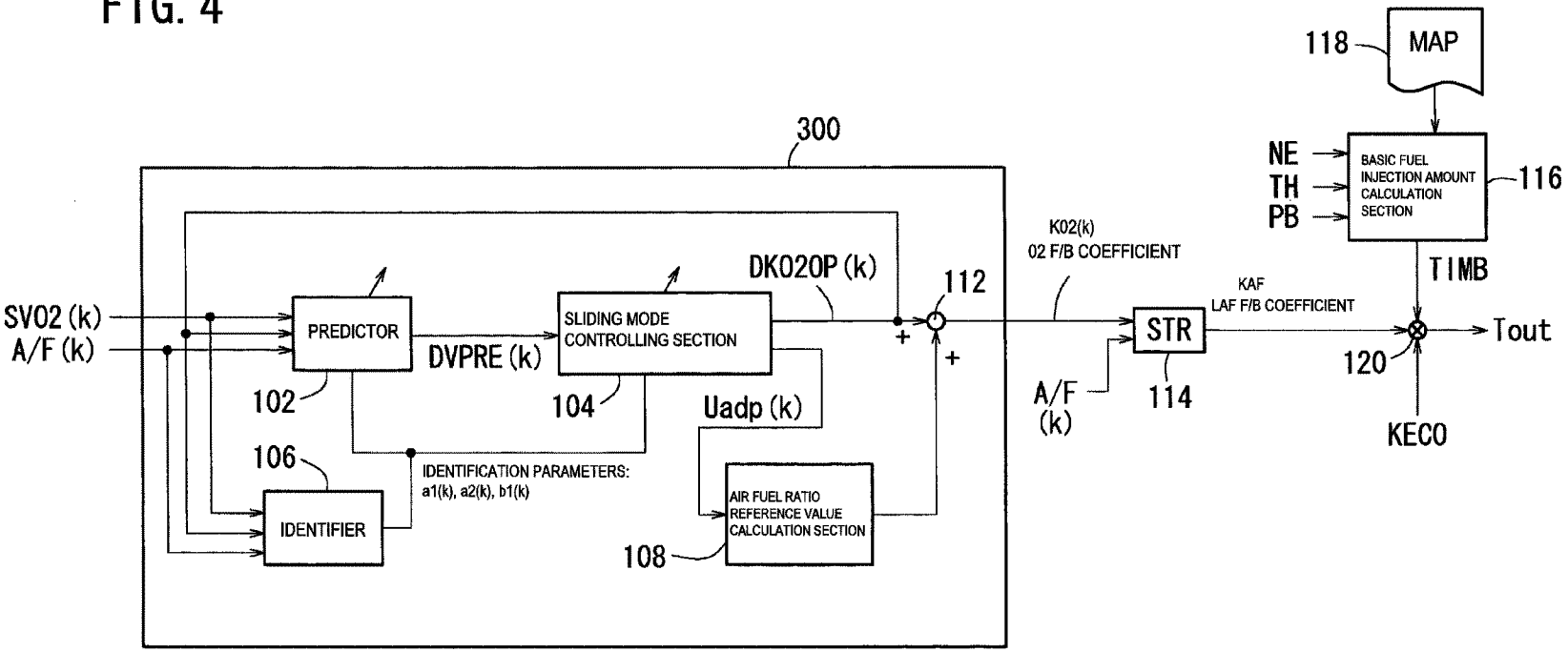
FIG. 4 is a controlling block diagram showing a configuration of an air fuel ratio controlling section according to a comparative example.

Here, operation of the predictor 102, first sliding mode controlling section 104, identifier 106 and air fuel ratio reference value calculation section 108 is described in comparison with a comparative example of FIG. 4.

First, it is premised that a LAF sensor 110 is installed on the upstream side of the catalytic apparatus 50 and a pre-catalyst air fuel ratio A/F(k) from the LAF sensor 110 is inputted to the air fuel ratio controlling section 300 according to the comparative example of FIG. 4.

The predictor 102 predicts an air fuel ratio (VO2) after lapse of a dead time period dt from the present time (k). The dead time period is corresponding to the distance from the fuel injection valve 40 to the oxygen sensor 52. This prediction is in order to determine the fuel injection amount or target air fuel ratio on the downstream side of the catalytic apparatus 50.

Figure 5:
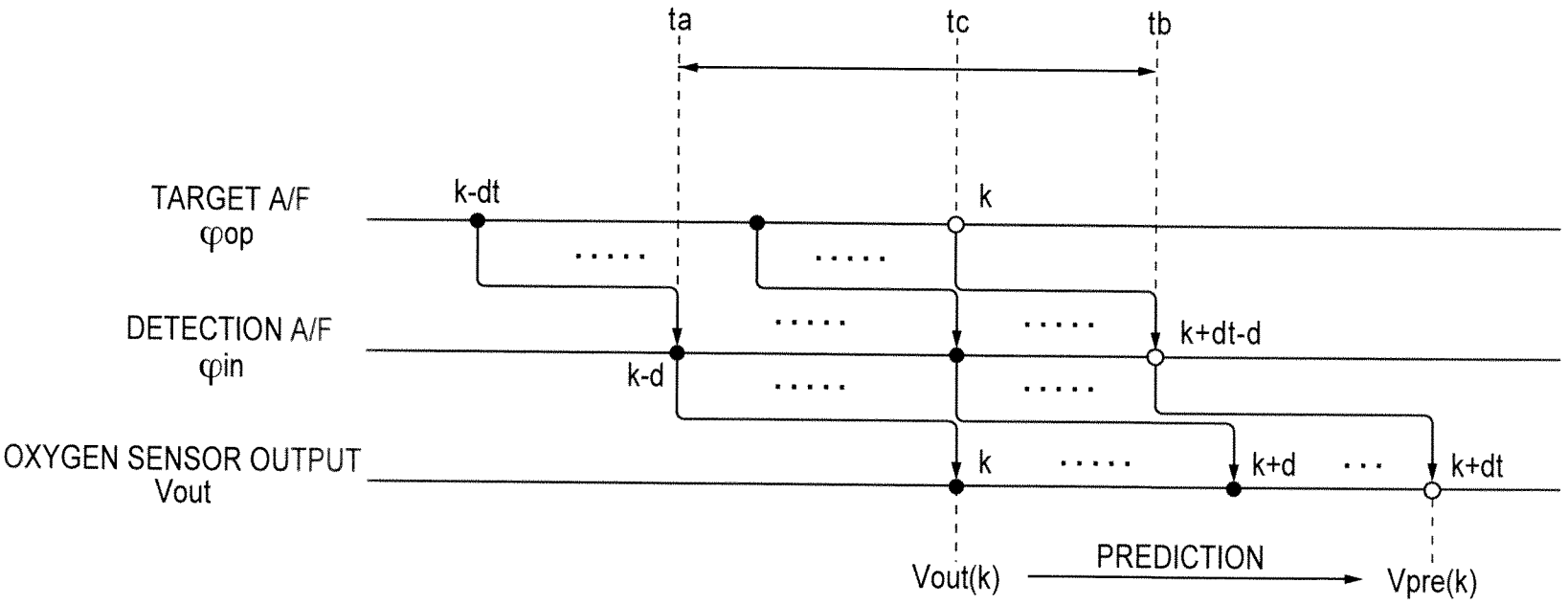
FIG. 5 is an explanatory view illustrating a prediction model by a predictor.
Figure 6:
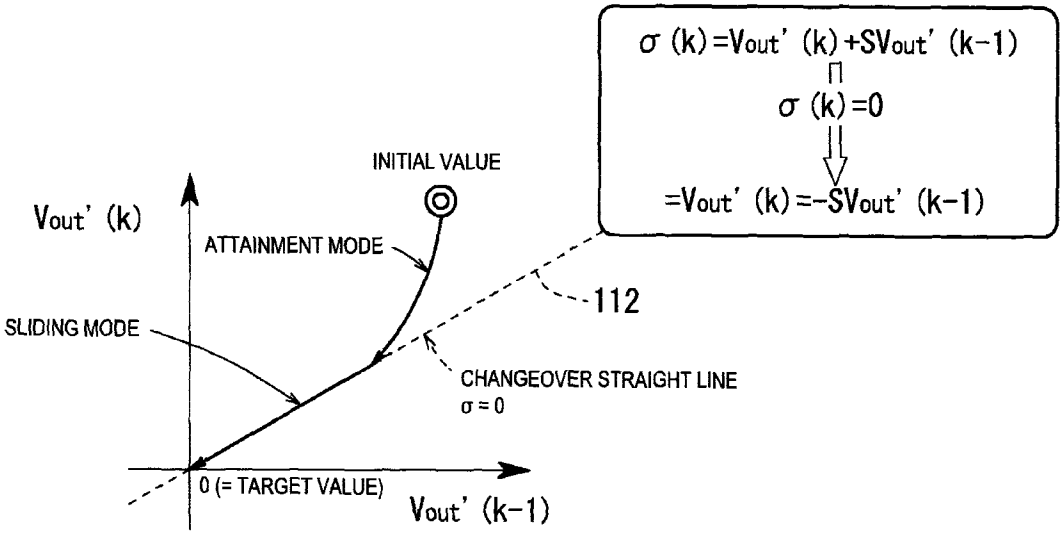
FIG. 6 is an explanatory view illustrating a concept of operation of sliding mode control.

A prediction model by the predictor 102 can predict, where the present time is represented by k, an output Vout(k+dt)=Vpre(k) at a time point k+dt from the following expression (1) if the air fuel ratio ϕin before the catalyst between time point to and time point tb and the output Vout of the oxygen sensor 52 are known as illustrated in FIG. 5.

$$Vpre(k) = \alpha 1 \times V'_{out}(k) + \alpha 2 \times V'_{out}(k-1) + \sum_{j=1}^{dt} \beta j \times \phi'_{in}(k + dt - d - j) \quad \text{[Expression 1]}$$

It should be noted that, since ϕin of j=1 to (dt−d−1) cannot be observed at the time point k, the target value (ϕop) is used instead. Here, Vout'(k) represents a deviation between the output of the oxygen sensor 52 and the target value at the time point k, and Vout'(k−1) represents a deviation between the output of the oxygen sensor 52 and the target value prior by one unit time, as a period of fixed time, to the timing point k. α1, α2 and βj are parameters determined by the identifier 106.

The first sliding mode controlling section 104 carries out calculation of an injection amount in response to a model error or predicted air fuel ratio−target value. Usually, sliding mode control is a feedback controlling technique of a variable structure type wherein, as seen from FIG. 6 which illustrates its concept, a changeover straight line represented by a linear function wherein a plurality of state amounts of a controlling object are used as variables is constructed in advance, those state amounts are converged at a high speed on the changeover straight line by high gain control (attainment mode) Further, while the state amounts are converged on the changeover straight line, they are converged to a required position of equilibrium (convergence point) on the changeover straight line by a so-called equivalent control input (sliding mode).

Such sliding mode control has a superior property that, if a plurality of state amounts of a controlling object are converged on a changeover straight line, then the state amounts can be converged stably to a position of equilibrium on the changeover straight line almost without being influenced by disturbance and so forth.

When a correction amount for an air fuel ratio of the engine 28 is to be determined so as to set the concentration of a particular component such as oxygen concentration of exhaust gas on the downstream side of the catalytic apparatus 50 to a predetermined appropriate value, the correction amount for the air fuel ratio is determined such that, determining, for example, a value of the concentration of a particular component of exhaust gas on the downstream side of the catalytic apparatus 50 and a changing rate of the concentration as state amounts of the exhaust system which is a target of the control, the state amounts are converged to a position of equilibrium on a changeover straight line (point at which the value of the concentration and the changing rate of the concentration become a predetermined appropriate value and "0", respectively) using sliding mode control. If a correction amount for the air fuel ratio is determined using sliding mode control, then it is possible to set the concentration of a particular component of exhaust gas on the downstream side of the catalyst to a predetermined appropriate value with a high degree of accuracy in comparison with conventional PID control or the like.

A changeover function and a controlling input calculation expression in the sliding mode control are such as given below.

$$\sigma(k)=V_{out}'(k)+SV_{out}'(k-1)(-1<S<0) \quad \text{[Expression 2]}$$

$$\phi_{op}(k)=U_{eq}(k)+U_{rch}(k)+U_{adp}(k) \quad \text{[Controlling input calculation expression]}$$

Equality Law Input $$U_{eq}(k)=\frac{1}{b1(k)}\{(1-S-a1(k))V'_{out}(k)+(S-a2(k))V'_{out}(k-1)\}$$

Derived from conditional expression of σ(k+1)=σ(k)

Attainment Law Input $$U_{rch}(k)=\frac{-K_{rch}}{b1(k)}\sigma(k)$$

Adaptation Law Input $$U_{adp}(k)=\frac{-K_{adp}}{b1(k)}\sum_{j=0}^{k}\sigma(i)$$

Here, Uek(k) is an equality law input, Urch(k) is an attainment law input and Uadp(k) is an adaptation law input, and they are calculated in accordance with the above expressions. Further, Vout'(k) and Vout'(k−1) here represent model errors, and Vout'(k) is a deviation between the predicted air fuel ratio and the target value at the time point k, and Vout'(k−1) represents a deviation between the predicted air fuel ratio and the target value prior by one unit time (a period of fixed time) to the time point k.

It is to be noted that Krch and Kadp represent feedback gains, and S represents a changeover function setting parameter.

The identifier 106 corrects a model parameter of the predictor 102 to compensate for the prediction accuracy at the predictor 102. Further, for the first sliding mode controlling section 104, the identifier 106 adjusts the parameters a1(k), a2(k) and b1(k) so that the deviation of Vout'(k+1) calculated in accordance with a model expression $$V_{out}'(k+1)=a1\times V_{out}'(k)+a2(k)\times V_{out}'(k-1)+b1(k)\times\phi_{in}'(k-d) \quad \text{[Expression 3]}$$

by adjustment of the convergence rate (feedback gain) to the changeover straight line of σ(k) in accordance with the model error may be minimized. This signifies that, by correcting the model parameters of the prediction expression, a corresponding relationship of Vout to the air fuel ratio ϕin before the catalyst and the target air fuel ratio ϕop is corrected.

As shown in FIG. 4, the air fuel ratio reference value calculation section 108 determines an air fuel ratio reference value for the engine 28 defined from the adaptation law input Uadp(k) from the first sliding mode controlling section 104 using a map set in advance.

An output from the first sliding mode controlling section 104, that is, a control input Uop (=DKO2OP(k)) to the exhaust system, is added to an air fuel ratio reference value from the air fuel ratio reference value calculation section 108 by an adder 112 to determine a target air fuel ratio KO2(k). This target air fuel ratio KO2(k) is inputted to an adaptive controlling section 114 at the succeeding stage. The adaptive controlling section 114 is a controller of the recurrence formula type which adaptively determines a feedback correction coefficient KAF from a detection air fuel ratio ϕin (=A/F(k)) of the LAF sensor 110 and the target air fuel ratio ϕop (KO2(k)) taking dynamic variations such as a variation of the operation state and a property variation of the engine 28 into consideration.

Then, a basic fuel injection amount calculation section 116 determines a reference fuel injection amount defined by the engine speed NE, throttle opening TH and intake air pressure PB using a basic fuel injection map 118 set in advance and corrects the reference fuel injection amount in response to the effective opening area of the throttle valve to calculate a basic fuel injection amount TIMB. This basic fuel injection amount TIMB is supplied to a multiplier 120, by which it is corrected with a feedback correction coefficient KAF from the adaptive controlling section 114 and an environmental correction coefficient KECO determined from the water temperature, intake air temperature, atmospheric air pressure and so forth. The corrected value is outputted as a fuel injection time period Tout from the multiplier 120.

Since the air fuel ratio controlling section 300 according to the comparative example having such a configuration as described above uses the LAF sensor 110 which is expensive, it has a problem in reduction of the cost and another problem that it cannot be applied in a motorcycle or the like which is limited in arrangement space. Therefore, in the air fuel ratio controlling section 300 according to the comparative example, where the LAF sensor 110 is not provided on the upstream of the catalytic apparatus 50, since the air fuel ratio ϕin before the catalyst cannot be measured, the prediction accuracy of the air fuel ratio after the catalyst sometimes deteriorates. Therefore, it is estimated that, if the predicted air fuel ratio is displaced by a great amount from the theoretical air fuel ratio due to a characteristic dispersion, a time-dependent variation and so forth of the engine 28 or the fuel injection valve 40, then the correction coefficient cannot be determined appropriately and it becomes difficult to achieve establishment of an appropriate air fuel ratio.

Therefore, the air fuel ratio controlling section 100 according to the present invention includes, as shown in FIG. 3, an adaptive model corrector 122 (adaptive model correction means) for superposing a second correction coefficient KTIMB on a first correction coefficient DKO2OP(k) so that a prediction error ERPRE(k) provided as a deviation between an actual air fuel ratio SVO2(k) and a predicted air fuel ratio DVPRE(k−dt) is reduced to zero. The air fuel ratio controlling section 100 further includes a second sliding mode controlling section 124 for carrying out feedback so that the error between the actual air fuel ratio SVO2(k) and a target value set in advance is reduced to zero at a stage at which the prediction accuracy of the predictor 102 deteriorates, and a control section 126 for controlling at least the first sliding mode controlling section 104 and the adaptive model corrector 122. The air fuel ratio controlling section 100 further includes a changeover section 128 for carrying out changeover between an output of the first sliding mode controlling section 104 side and an output of the second sliding mode controlling section 124 side in accordance with an instruction from the control section 126. The changeover section 128 usually selects an output of the first sliding mode controlling section 104 side and changes over the selection to an output of the second sliding mode controlling section 124 side in accordance with a changeover instruction signal from the control section 126.

The air fuel ratio controlling section 100 further includes a time adjustment section 130 for delaying a predicted air fuel ratio DVPRE(k) from the predictor 102 by a dead time period dt, and a subtractor 132 for calculating a difference between the output DVPRE(k−dt) from the time adjustment section 130 and the actual air fuel ratio SVO2(k) from the oxygen sensor 52 as a prediction error ERPRE(k). The prediction error ERPRE(k) from the subtractor 132 is supplied to the adaptive model corrector 122. To the second correction coefficient KTIMB outputted from the adaptive model corrector 122, 1 is added by an adder 134. An output of the adder 134 and the target air fuel ratio KO2(k) are multiplied by a multiplier 136, from which the product is outputted as a correction air fuel ratio wherein the second correction coefficient KTIMB is superposed on the target air fuel ratio KO2(k). From this correction air fuel ratio, the air fuel ratio reference value is subtracted by a subtractor 138, and the difference is inputted to the predictor 102 and the identifier 106.

Figure 7:
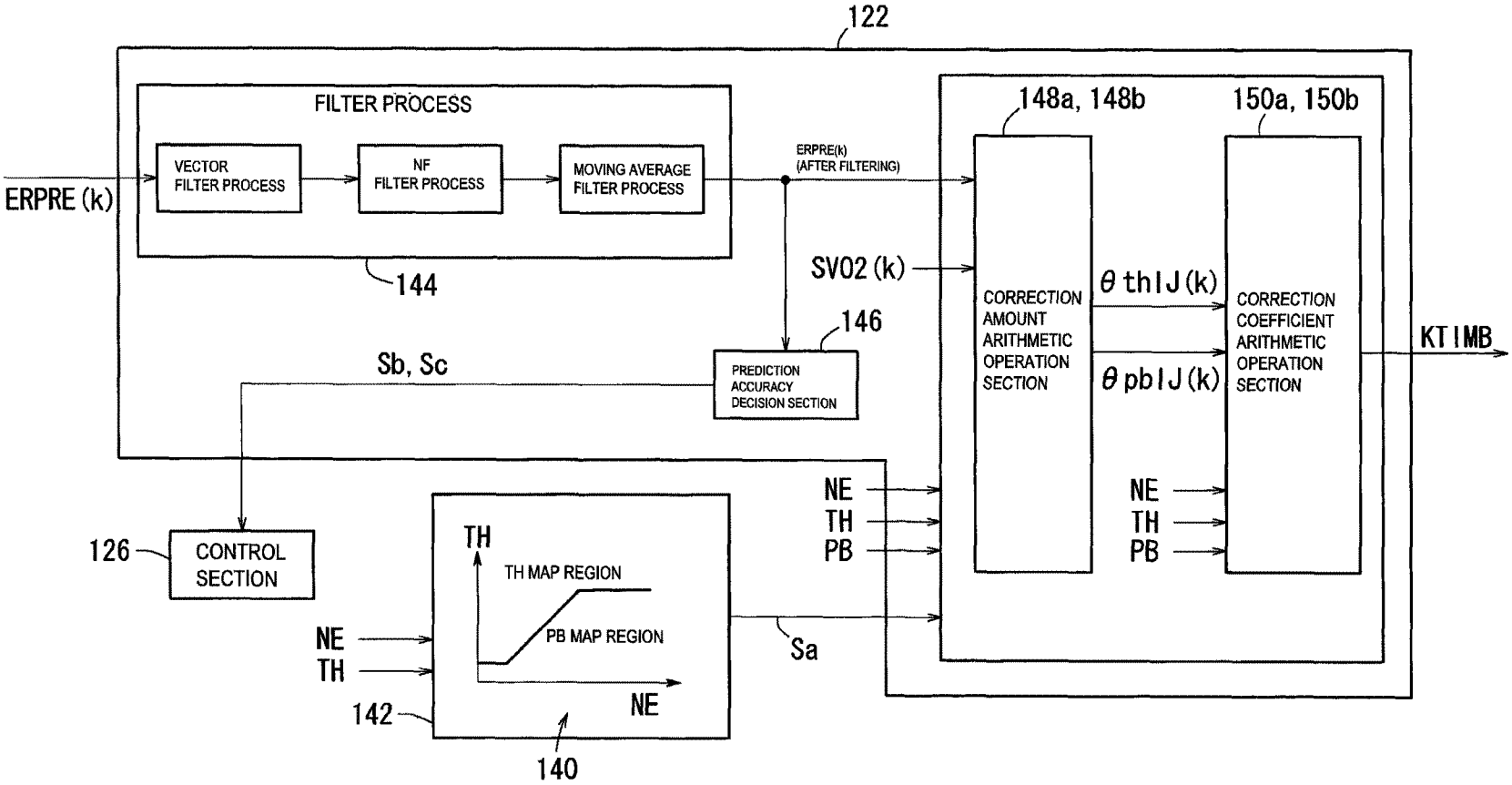
FIG. 7 is a block diagram showing a configuration of an adaptive model corrector.

The basic fuel injection map 118 described hereinabove includes a first basic fuel injection map 118*a* based on the engine speed NE and the throttle opening TH, and a second basic fuel injection map 118*b* based on the engine speed NE and the intake air pressure PB. Accordingly, the air fuel ratio controlling section 100 includes a map selection section 142 for selectively designating a basic fuel injection map to be used from a selecting map 140, in which indices of basic fuel injection maps to be used are arrayed, based on the engine speed NE and the throttle opening TH from between the first basic fuel injection map 118*a* and the second basic fuel injection map 118*b*. As shown in FIG. 7, in the selecting map 140, a region in which the first basic fuel injection map 118*a* is to be used and another region in which the second basic fuel injection map 118*b* is to be used are disposed. The map selection section selects a basic fuel injection map to be used from the selecting map 140 based on the engine speed NE and the throttle opening TH inputted thereto, and outputs a selection result Sa. When the engine speed NE is low, the probability that the first basic fuel injection map 118*a* may be selected is high, but when the engine speed NE is high, the probability that the second basic fuel injection map 118*b* may be selected is high.

Accordingly, the basic fuel injection amount calculation section 116 determines a reference fuel injection amount defined by the engine speed NE, throttle opening TH and intake air pressure PB using the basic fuel injection map selected by the map selection section 142, and corrects the reference fuel injection amount in accordance with the effective opening area of the throttle valve 38 to calculate a basic fuel injection amount TIMB. This basic fuel injection amount TIMB is corrected with the target air fuel ratio KO2(k) from the changeover section 128 and the environmental correction coefficient KECO determined from the water temperature, intake air temperature, atmospheric pressure and so forth and then outputted as a fuel injection time period Tout.

As shown in FIG. 7, the adaptive model corrector 122 includes a filter processing section 144 for carrying out various filter processes for the prediction error ERPRE(k) at a first stage, and a prediction accuracy decision section (prediction accuracy decision means) 146 for deciding prediction accuracy based on the prediction error ERPRE(k) after the filter processing. The adaptive model corrector 122 further includes a first correction amount arithmetic operation section 148*a* and a first correction coefficient arithmetic operation section 150*a* corresponding to the first basic fuel injection map 118*a*, and a second correction amount arithmetic operation section 148*b* and a second correction coefficient arithmetic operation section 150*b* corresponding to the second basic fuel injection map 118*b*.

The first correction amount arithmetic operation section 148*a* feeds back, when the first basic fuel injection map 118*a* is selected by the map selection section 142, a prediction error correction amount θth(i,j) in a fixed time period so that the prediction error ERPRE(k) on which a weight component based on the engine speed NE and the throttle opening TH is reflected is reduced to zero. For example, prior by the dead time period to the time point k, that is, at the time point (k−dt), arithmetic operation is started, and such arithmetic operation is carried out in a period of fixed time. Then at the time point k, a prediction error correction amount θthIJ(k) is outputted.

Figure 8:
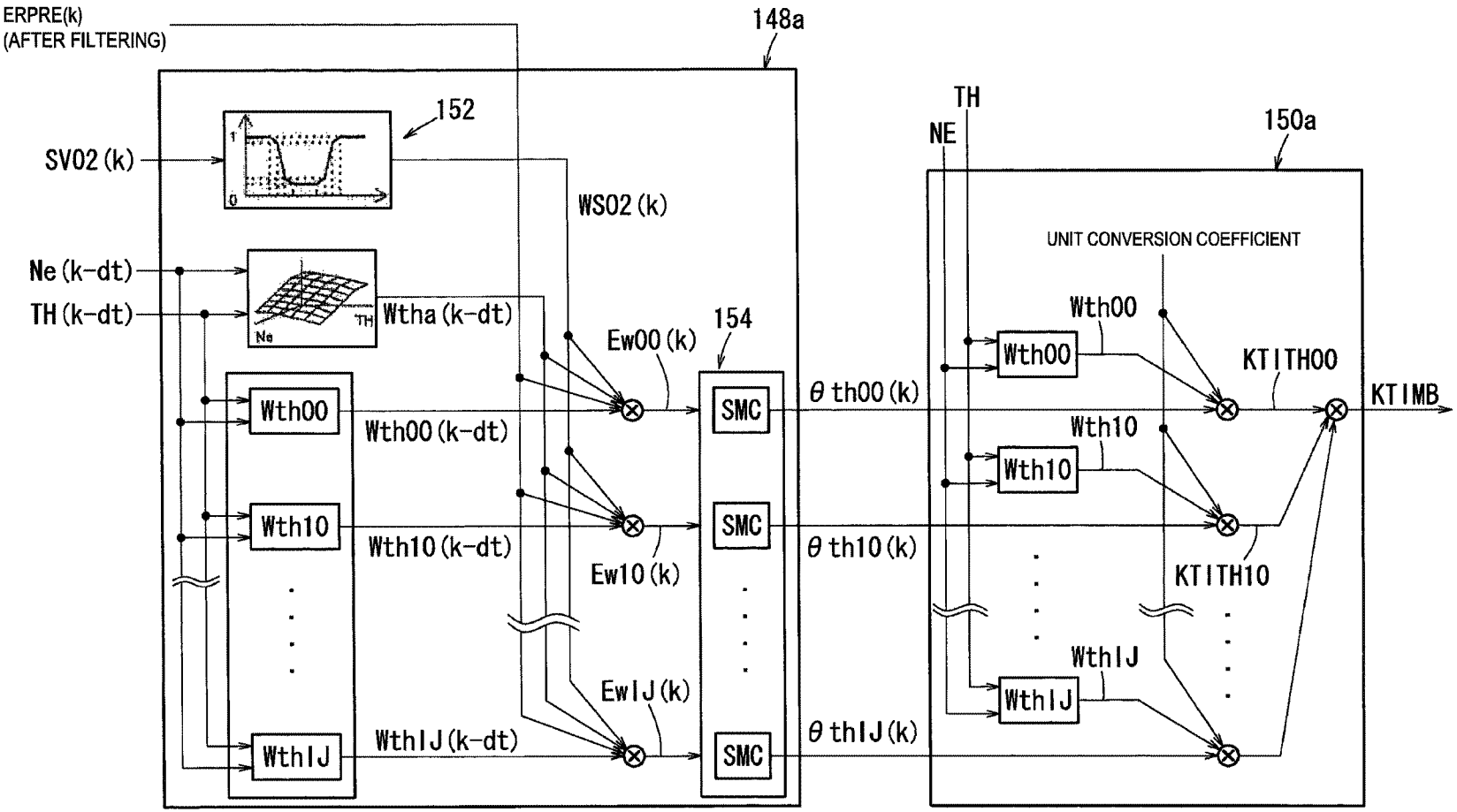
FIG. 8 is a block diagram showing a particular configuration of the adaptive model corrector.

In particular, as shown in FIG. 8, the first correction amount arithmetic operation section 148*a* includes a weighting section 152 for superposing, in every fixed time period, a first weight component WSO2S(k) on which the sensitivity with respect to the air fuel ratio of the oxygen sensor 52 is reflected, a second weight component Wtha(k−dt) on which a variation of a value of the first basic fuel injection map 118*a* with respect to a variation of the engine speed NE and the throttle opening TH is reflected, and third weight components WthIJ(k−dt) corresponding to a plurality of regions obtained by segmenting the first basic fuel injection map 118*a* based on the engine speed NE and the throttle opening TH, on the prediction error ERPRE(k) to obtain correction model errors EwIJ(k) corresponding to the plural regions. The first correction amount arithmetic operation section 148*a* further includes a sliding mode controlling section 154 for feeding back prediction error correction amounts θthIJ (k) corresponding to the plural regions in a fixed time period so that the correction model errors EwIJ(k) corresponding to the plural regions may be reduced to zero.

Figure 9A:
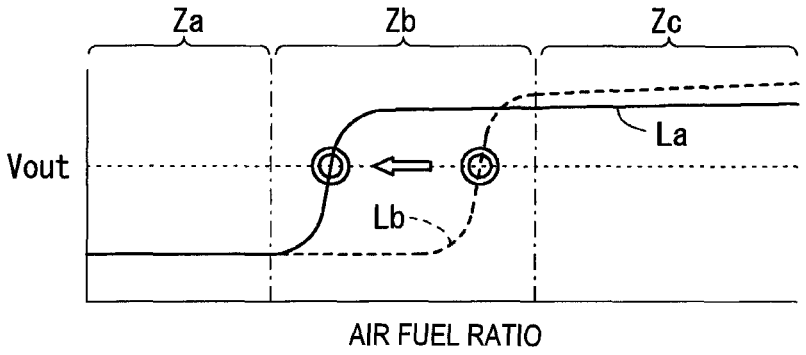
FIG. 9A is a characteristic diagram illustrating a variation of an output of an oxygen sensor with respect to an air fuel ratio A/F.
Figure 9B:
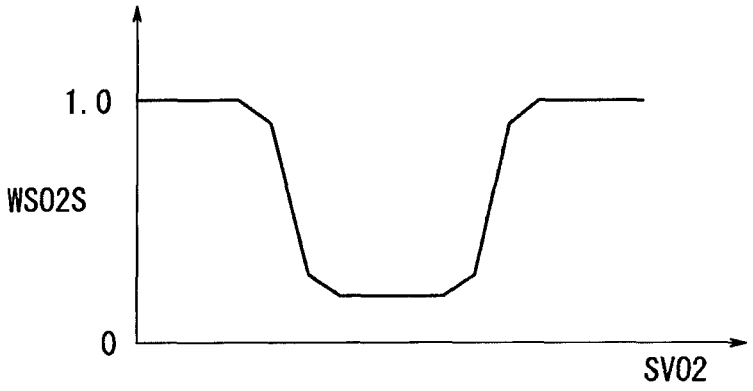
FIG. 9B is a characteristic diagram illustrating a variation of a first weight component with respect to an actual air fuel ratio.

The first weight component WSO2S(k) is described. The output Vout of the oxygen sensor 52 has a nonlinear characteristic with respect to the air fuel ratio A/F as shown in FIG. 9A. In regions Za and Zc, even if the air fuel ratio varies, the output Vout of the oxygen sensor 52 varies little. On the other hand, in a region Zb, the output Vout of the oxygen sensor 52 varies by a great amount in response to a small variation of the air fuel ratio A/F. It is to be noted that, in FIG. 9A, a solid line La indicates a characteristic of a new product after the catalyst, and a broken line Lb indicates a characteristic after the catalyst which undergoes time-dependent degradation. If such a characteristic as just described is reflected as it is on the correction model error EwIJ(k), then the sudden variation in the region Zb is inputted to the sliding mode controlling section 154, and there is a problem that time is required to reduce the correction model error EwIJ(k) to zero. Therefore, as shown in FIG. 9B, the value for weighting is changed in a reducing direction so that the sudden variation in the region Zb may be moderated.

Figure 10A:
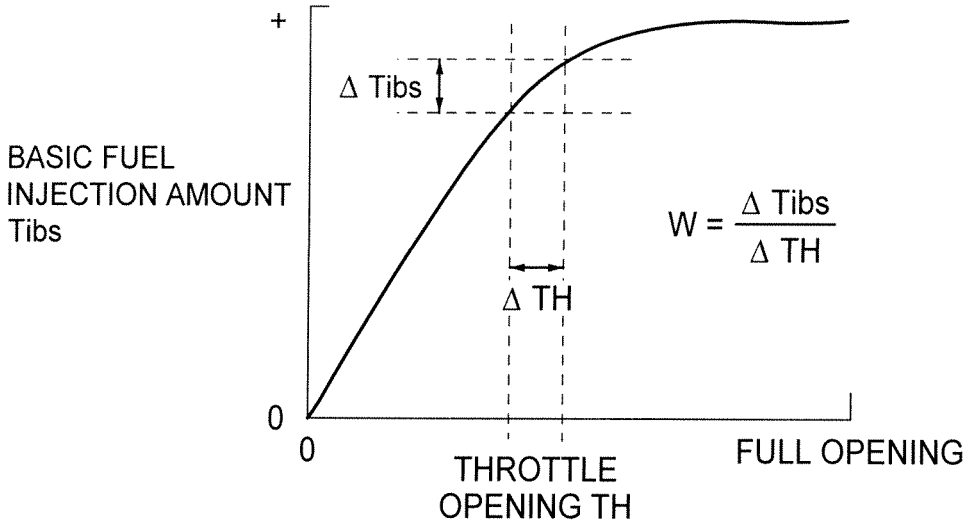
FIG. 10A is a characteristic diagram illustrating a variation of a basic fuel injection amount with respect to a throttle opening.
Figure 10B:
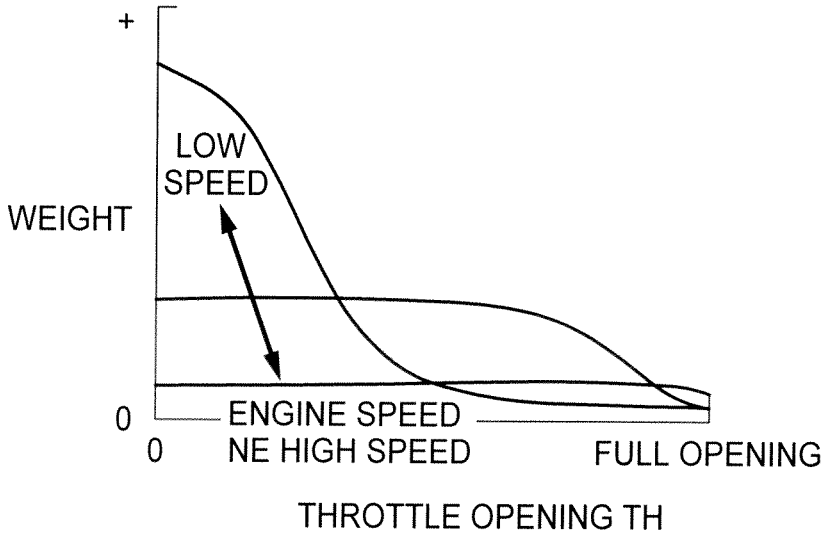
FIG. 10B is a characteristic diagram illustrating a variation of a second weight component with respect to a throttle opening.

The second weight component Wtha is described. The probability that the prediction error ERPRE of the output SVO2 of the oxygen sensor 52 is caused by a detection error of the throttle opening TH increases as the gradient of the basic fuel injection amount Tibs with respect to the variation of the throttle opening TH increases as shown in FIG. 10A. When a detection error appears and the reference point of a value of the basic fuel injection amount on the basic fuel injection map is displaced, the variation amount of the air fuel ratio increases as the "variation amount by the displacement value at the reference point" increases. Therefore, for each engine speed NE, "(gradient of the basic fuel injection amount Tibs with respect to the variation of the throttle opening TH)÷(value of the basic fuel injection amount Tibs)" is set. As a result, as shown in FIG. 10B, when the engine speed NE is high, the second weight component Wtha is substantially equal over the range from the fully closed state to the fully open state of the throttle opening TH. However, as the engine speed NE decreases, the second weight component Wtha increases as the throttle opening TH decreases.

Figure 11A:
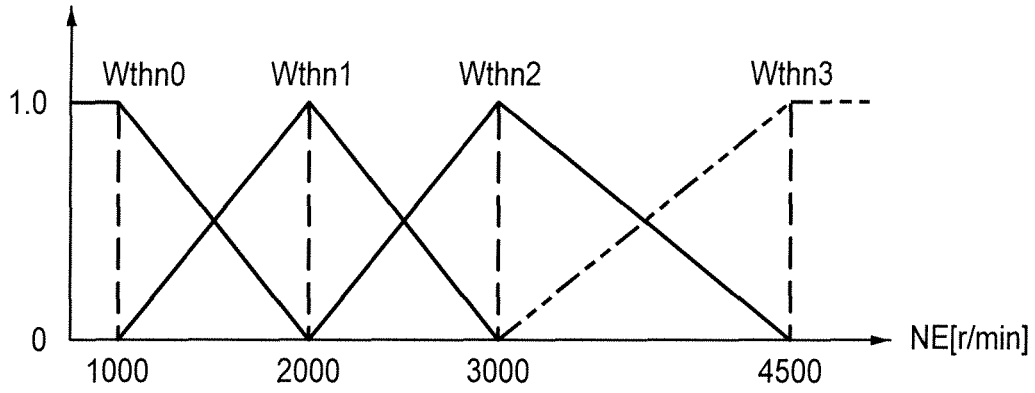
FIG. 11A is a characteristic diagram illustrating a weighting function with respect to an engine speed NE.
Figure 11B:
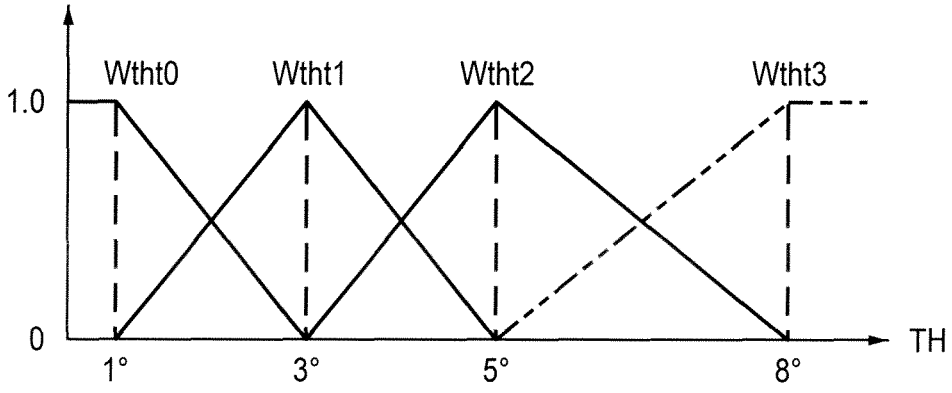
FIG. 11B is a characteristic diagram illustrating a weighting function with respect to a throttle opening TH.

The third weight components WthIJ are functions wherein, when the weighting functions with regard to 1000, 2000, 3000 and 4500 (rpm) of the engine speed NE as shown in FIG. 11A are considered, the weighting value of each function linearly drops from an apex at the corresponding engine speed NE to an adjacent apex. It is to be noted, however, that, in FIG. 11A, where the engine speed is equal to or lower than 1000 rpm, or equal to or higher than 4500 rpm, the weighting value is fixed. Similarly, when the weighting functions for 1°, 3°, 5° and 8° of the throttle opening TH as shown in FIG. 11B are considered, the weighting value of each function linearly drops from an apex at the corresponding throttle opening TH to an adjacent apex. It is to be noted, however, that, in FIG. 11B, where the throttle opening is equal to or smaller than 1°, or equal to or greater than 8°, the weighting value is fixed.

Then, the weight Wthn(i) based on the engine speed NE and the weight Wtht(j) based on the throttle opening TH are multiplied to determine a third weight component WthIJ.

It is to be noted that the sliding mode controlling section 154 feeds back, for a region in which the third weight component WthIJ satisfies WthIJ >0, the prediction error correction amount θthIJ so that the correction model error EwIJ may be reduced to zero, but carries out, for another region in which the third weight component WthIJ satisfies WthIJ=0, operation by which the prediction error correction amount θthIJ is not updated because the operation amount is zero.

Figure 12:
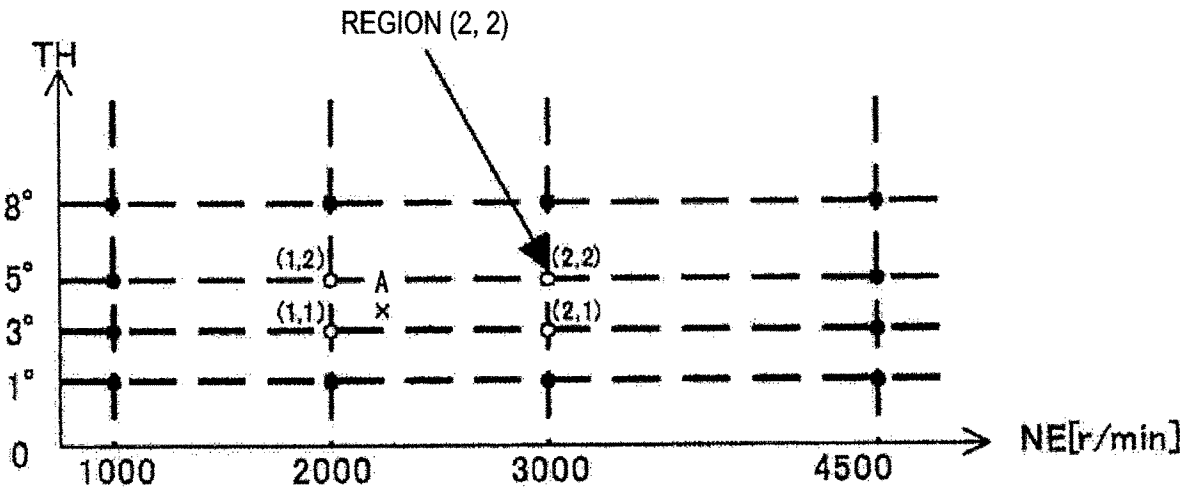
FIG. 12 is a view illustrating a principle of determination of a correction coefficient from a prediction error correction amount.

The first correction coefficient arithmetic operation section 150*a* superposes the third weight components WthIJ corresponding to the plural regions on the prediction error correction values θthIJ(k) corresponding to the plural regions at a predetermined timing to determine correction coefficients KTITHIJ corresponding to the plural regions, and adds all correction coefficients to determine a second correction coefficient KTIMB. Here, since all correction coefficients are added, the third weight components WthIJ indicate the weights corresponding to points of the first basic fuel injection map 118*a* determined from the engine speed NE and the throttle opening TH in a region in which the points are included. Accordingly, as shown in FIG. 12, a plurality of regions having lattice points at the engine speeds 1000, 2000, 3000 and 4500 (rpm) and the throttle openings 1°, 3°, 5° and 8° are produced. If, among the points mentioned, the point determined from the engine speed NE and the throttle opening TH inputted is a point A, then a correction coefficient corresponding to the point A is complemented with correction coefficients at four points around the point A.

On the other hand, if the second basic fuel injection map 118*b* is selected by the map selection section 142, then the second correction amount arithmetic operation section 148*b* feeds back the prediction error correction amount in a fixed time period so that the prediction error on which the weight component based on the engine speed NE and the intake air pressure PB is reflected may be reduced to zero. For example, prior by the dead time period to the time point k, that is, at the time point (k−dt), arithmetic operation is started, and the arithmetic operation is carried out in the fixed time period. Then at the time point k, a prediction error correction amount θpbIJ(k) is outputted. It is to be noted that, since a particular configuration of the second correction amount arithmetic operation section 148*b* is substantially the same as that of the first correction amount arithmetic operation section 148*a* shown in FIG. 8, overlapping description of the same is omitted.

The second correction coefficient arithmetic operation section 150*b* superposes the third weight components corresponding to the plural regions on the prediction error correction amounts θpbIJ(k) corresponding to the plural regions at a predetermined timing to determine correction coefficients corresponding to the plural regions, and adds all correction coefficients to determine a second correction coefficient KTIMB. Also a particular configuration of the second correction coefficient arithmetic operation section 150*b* is substantially the same as that of the first correction coefficient arithmetic operation section 150*a* shown in FIG. 8, and therefore, overlapping description of the same is omitted.

The prediction accuracy decision section 146 determines, when a state in which the moving average of the prediction error ERPRE(k) after the filter processing is higher than a predetermined value set in advance has continued by a preset number of times or more, that the prediction accuracy has deteriorated, and outputs a prediction accuracy deterioration signal Sb. Further, when a state in which the moving average of the prediction error after the filter processing is equal to or lower than a predetermined value set in advance has continued by a preset number of times or more, the prediction accuracy decision section 146 determines that the prediction accuracy is assured, and outputs a prediction accuracy assurance signal Sc. The prediction accuracy deterioration signal Sb and the prediction accuracy assurance signal Sc are supplied to the control section 126.

The control section 126 temporarily stops the processing by the first sliding mode controlling section 104 and temporarily stops the identifier based on an input of the prediction accuracy deterioration signal Sb, and shortens the starting period of the adaptive model corrector 122 during the stopping as shown in FIG. 3. In other words, the fixed time period after which the first correction amount arithmetic operation section 148*a* and the second correction amount arithmetic operation section 148*b* are to be started is shortened.

Further, the control section 126 outputs a changeover instruction signal Sd to the changeover section 128 in response to an input of the prediction accuracy deterioration signal Sb. The changeover section 128 carries out changeover to an output of the second sliding mode controlling section 124 side in response to an input of the changeover instruction signal Sd. Further, the control section 126 controls the second sliding mode controlling section 124 to start processing in response to an input of the prediction accuracy deterioration signal Sb. In this instance, the prediction air fuel ratio from the predictor 102 is not used. The second sliding mode controlling section 124 carries out feedback so that the error between the actual air fuel ratio (SVO2) and a target value set in advance (for example, a fixed value representative of a stoichiometric region) is reduced to zero. An output from the second sliding mode controlling section 124 is supplied to the multiplier 120 through the changeover section 128. The basic fuel injection amount calculation section 116 determines a reference fuel injection amount defined by the engine speed NE, throttle opening TH and intake air pressure PB using a basic fuel injection map set in advance or a basic fuel injection map selected by the map selection section 142, and corrects the reference fuel injection amount in accordance with the effective opening area of the throttle valve 38 to calculate a basic fuel injection amount TIMB. This basic fuel injection amount TIMB is corrected with an output from the changeover section 128 (target air fuel ratio KO2(k)) and an environmental correction coefficient KECO determined from the water temperature, intake air temperature, atmospheric pressure and so forth, and is outputted as a fuel injection time period Tout.

The temporary stopping of the first sliding mode controlling section 104 and the identifier 106 may be canceled in response to an output of the prediction accuracy assurance signal Sc from the prediction accuracy decision section 146 or may be canceled after a predetermined period of time set in advance (period of time in which the prediction accuracy is expected to be assured) elapses. In this instance, since supply of the changeover instruction signal Sd from the control section 126 to the changeover section 128 is stopped, the changeover section 128 carries out changeover to the output of the first sliding mode controlling section 104 side. Further, the control section 126 returns the fixed time period in which the first correction amount arithmetic operation section 148*a* and the second correction amount arithmetic operation section 148*b* of the adaptive model corrector 122 are to be started, to the original period. Further, the control section 126 cancels the temporary stopping of the first sliding mode controlling section 104 and resets the parameter of the identifier 106 to the initial value.

In this manner, in the air fuel ratio controlling apparatus 10 (air fuel ratio controlling section 100) according to the present embodiment, a value obtained by subtracting an air fuel ratio reference value from a value obtained by superposing the second correction coefficient KTIMB on the target air fuel ratio KO2(k) is inputted to the predictor 102 and the identifier 106. In particular, since the predicted air fuel ratio DVPRE(k) after the dead time period dt is outputted from the predictor 102 based on the actual air fuel ratio SVO2(k), by delaying the predicted air fuel ratio DVPRE(k) by the dead time period dt, the difference between the actual air fuel ratio SVO2(k) and the predicted air fuel ratio DVPRE(k−dt) which coincide in time with each other is inputted as the prediction error ERPRE(k) to the adaptive model corrector 122. The second correction coefficient KTIMB is superposed on the first correction coefficient DKO2OP(k) so that the prediction error ERPRE(k) may be reduced to zero, and a resulting value is inputted from the adaptive model corrector 122 to the predictor 102 and the identifier 106 so that it is reflected on the processing by the predictor 102.

In particular, the first correction coefficient DKO2OP(k) obtained by feedback so that the deviation between the predicted air fuel ratio DVPRE(k) from the predictor 102 and the target air fuel ratio KO2(k) may be reduced to zero, and the second correction coefficient KTIMB obtained by feedback so that the prediction error ERPRE(k) may be reduced to zero are inputted in a superposed state to the predictor 102. Therefore, even if the LAF sensor 110 which is conventionally installed on the upstream side of the catalytic apparatus 50 is eliminated, the prediction accuracy of the air fuel ratio on the downstream side of the catalytic apparatus 50 can be assured, and therefore, the air fuel ratio of exhaust gas on the downstream side of the catalytic apparatus 50 can be converged to an appropriate value. As a result, it becomes possible to assure a purification performance of the catalytic apparatus 50. Further, even if an air fuel ratio error by a characteristic dispersion, a time-dependent variation and so forth of the engine 28 or the fuel injection valve 40 and so forth arises, deterioration of the prediction accuracy can be prevented. Since the LAF sensor 110 can be omitted as described above, a harness relating to the LAF sensor 110 and an interface circuit of the ECU 62 can be omitted, and reduction of the cost of the system, reduction of the space for the disposition and so forth can be achieved. Consequently, it is possible to easily apply the air fuel ratio controlling apparatus 10 to a vehicle which has a limited disposition space such as the motorcycle 12. Usually, in order to assure a good operation characteristic, it is necessary for the LAF sensor 110 to maintain a fixed temperature by means of a heater. However, in the present embodiment, since also the heater for the LAF sensor can be omitted, reduction of power consumption and improvement in fuel cost can be anticipated.

Furthermore, in the present embodiment, since the processing by the first sliding mode controlling section 104 is temporarily stopped in response to an input of the prediction accuracy deterioration signal Sb, the restriction to the period with regard to the adaptive model corrector 122 can be eliminated and the fixed time period in which the first correction amount arithmetic operation section 148*a* and the second correction amount arithmetic operation section 148*b* are to be started can be shortened. Therefore, the time period until the prediction error ERPRE(k) is set to zero can be shortened.

Further, since the processing by the second sliding mode controlling section 124 is started in response to an input of the prediction accuracy deterioration signal Sb without using the predicted air fuel ratio DVPRE(k) from the predictor 102, the fuel injection amount is controlled so that the actual air fuel ratio SVO2(k) approaches a predetermined target value, and the prediction accuracy can be assured in short time.

By such processing operation as described above, even in such cases as described in (a) to (c) to be given below, the air fuel ratio on the downstream side of the catalytic apparatus 50 can be converged to an appropriate value, and emission degradation by the fact that a state in which the air fuel ratio of exhaust gas on the downstream side of the catalytic apparatus 50 cannot be converged to an appropriate value continues can be eliminated.

(a) A case in which the identifier 106 suffers from a great prediction error which exceeds an adjustable range of the predictor 102 because an air fuel ratio error is generated by a characteristic dispersion, a time-dependent variation and so forth of the engine 28 or the fuel injection valve 40 and so forth.

(b) A case in which a dynamic characteristic of the controlling object varies suddenly (an exhaust gas volume variation by a variation of a driving condition, use of fuel in which ethanol is mixed or the like).

(c) A case in which the oxygen sensor 52 has an insensitive band (region in which the output of the oxygen sensor 52 little varies even if the air fuel ratio varies).

Further, in the present embodiment, at a stage at which it is decided that the prediction accuracy is assured, the starting period of the adaptive model corrector 122 is returned to its original period and the temporary stopping of the first sliding mode controlling section 104 is canceled. Therefore, since, at the stage at which the prediction accuracy is assured, production of the first correction coefficient DKO2OP(k) by the first sliding mode controlling section 104 is re-started, the prediction accuracy is improved further, and optimization of the air fuel ratio on the downstream of the catalytic apparatus 50 can be hastened.

In this instance, since the parameter of the identifier 106 is reset to its initial value, when the prediction accuracy is assured or at a stage at which it is expected that the prediction accuracy is assured, it is possible to maintain the assurance of the prediction accuracy by using the initial value as the identification parameter without using the identification parameter used when the prediction accuracy deteriorates. Consequently, optimization of the air fuel ratio on the downstream of the catalytic apparatus 50 can be hastened.

Further, in the first correction amount arithmetic operation section 148*a* of the adaptive model corrector 122, the prediction error correction amount θthIJ is fed back so that the prediction error on which a weight component based on the engine speed NE and the throttle opening TH with respect to the first basic fuel injection map 118*a* is reflected is reduced to zero in a fixed time period. Further, the first correction coefficient arithmetic operation section 150*a* determines the second correction coefficient KTIMB based on the prediction error correction amount θthIJ at a predetermined timing. Therefore, even if the LAF sensor 110 installed on the upstream of the catalytic apparatus 50 is removed, optimization of the air fuel ratio on the downstream of the catalytic apparatus 50 can be anticipated.

Particularly, prediction error correction amounts θthIJ corresponding to a plurality of regions obtained by segmenting the first basic fuel injection map 118*a* based on the engine speed NE and the throttle opening TH are fed back so that correction model errors EwIJ corresponding to the plural regions may be reduced to zero. Further, the correction coefficients KTITHIJ corresponding to the plural regions are determined based on the prediction error correction amounts θthIJ corresponding to the plural regions at a predetermined timing, and all correction coefficients are added to determine the second correction coefficient KTIMB. Therefore, the second correction coefficient KTIMB has a value with which a map value to be used is corrected with the correction coefficients KTITHIJ of the plural regions so that the prediction error ERPRE(k) may be reduced to zero. Accordingly, by superposing the second correction coefficient KTIMB having such a characteristic as described above on the first correction coefficient DKO2OP, optimization of the air fuel ratio on the downstream of the catalytic apparatus 50 can be anticipated.

This applies also to the second correction amount arithmetic operation section 148*b* and the second correction coefficient arithmetic operation section 150*b* corresponding to the second basic fuel injection map 118*b*.

In the example described above, at a stage at which deterioration of the prediction accuracy is decided, the processing of the first sliding mode controlling section 104 and the identifier 106 is temporarily stopped, and the changeover section 128 carries out changeover to an output from the second sliding mode controlling section 124. However, the processing of the first sliding mode controlling section 104 and the identifier 106 may be temporarily stopped, for example, in response to an input of a signal Se from the ECU 62 representing that an air fuel ratio feedback condition is satisfied such that the changeover section 128 carries out changeover to an output from the second sliding mode controlling section 124. In this instance, in a case in which a prediction error is generated in accordance with a driving condition or the like before an air fuel ratio feedback condition is satisfied, the prediction error can be eliminated at an initial stage after a point of time at which the air fuel ratio feedback condition is satisfied. It is to be noted that the temporary stopping described hereinabove may be canceled after a predetermined time period set in advance (period of time in which the prediction accuracy is expected to be assured) elapses from a point of time of inputting of the signal Se indicating that the air fuel ratio feedback condition is satisfied.

Further, if, at a stage at which a period of time set in advance (predetermined time) elapses after deterioration of the prediction accuracy is decided, the starting time of the adaptive model corrector 122 is returned to its original period and the temporary stopping of the first sliding mode controlling section 104 is canceled, then at a stage at which the prediction accuracy is assured after the predetermined time elapses by once or more, production of the first correction coefficient DKO2OP(k) by the first sliding mode controlling section 104 is re-started. Therefore, the prediction accuracy is improved, and optimization of the air fuel ratio on the downstream of the catalytic apparatus 50 can be hastened. By setting the predetermined period of time for once to a period of time in which the prediction accuracy is expected to be assured, the prediction accuracy is assured at a point of time at which the predetermined time period elapses twice at the longest.

Further, similar effects can be achieved even if the operation gain of the correction coefficient by the adaptive model corrector 122 is increased from an ordinary level in place of temporarily stopping the processing of the first sliding mode controlling section 104 and the identifier 106 and shortening the starting period of the adaptive model corrector 122.

In the example described above, when the prediction accuracy deteriorates, the second sliding mode controlling section 124 carries out feedback control (in this instance, sliding mode control) so that the error between the actual air fuel ratio SVO2(k) and a target value set in advance may be reduced to zero. However, ordinary PID control may be used instead. In this instance, it is possible to assure the prediction accuracy quickly.

Now, modifications to the air fuel ratio controlling section 100 according to the present embodiment are described with reference to FIGS. 13 to 17.

Figure 13:
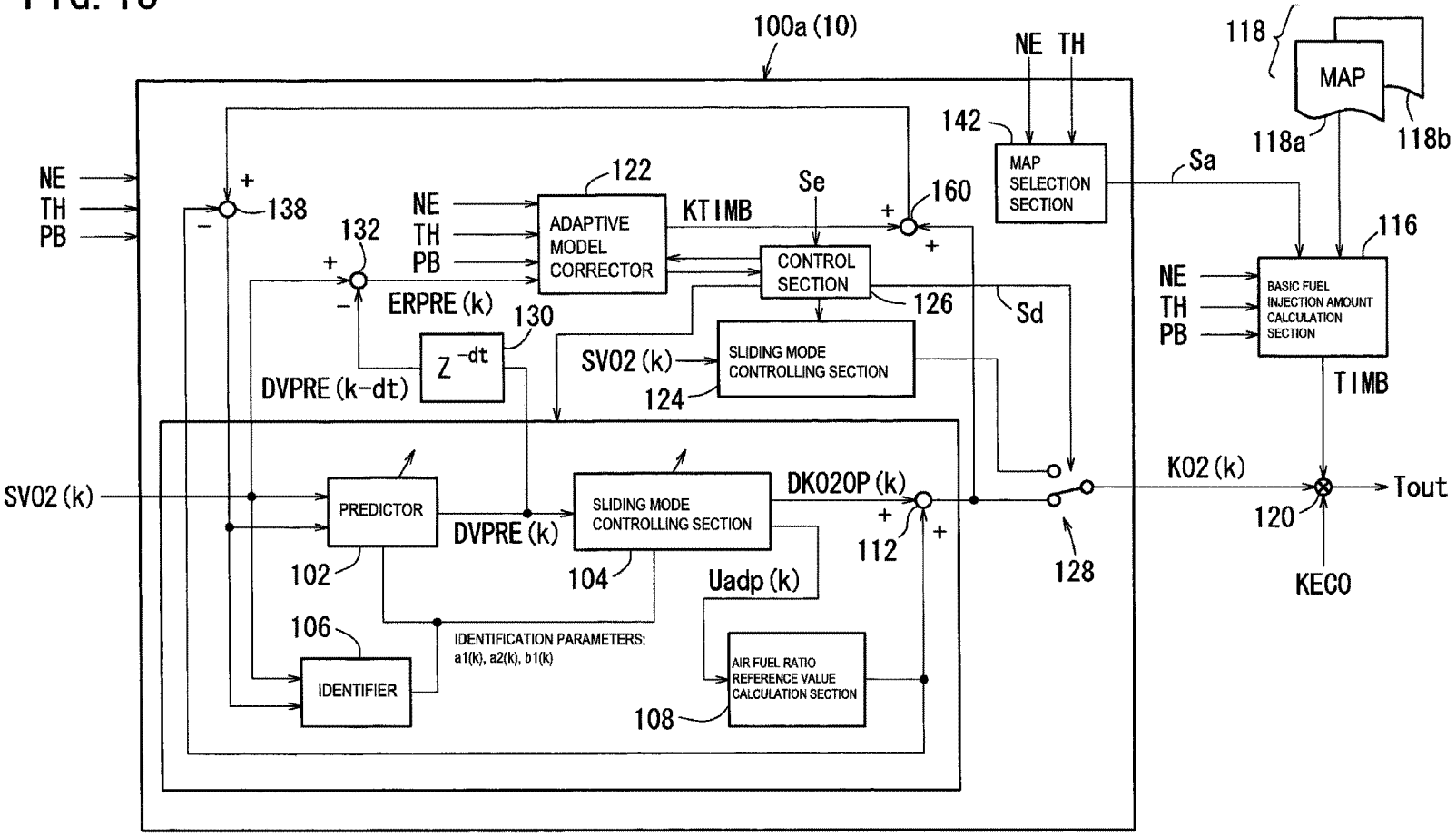
FIG. 13 is a controlling block diagram showing a configuration of an air fuel ratio controlling section according to a first modification.

Although the air fuel ratio controlling section 100*a* according to the first modification has a substantially similar configuration to that of the air fuel ratio controlling section 100 according to the present embodiment as shown in FIG. 13, it is different in that the target air fuel ratio KO2(k) from the adder 112 and the second correction coefficient KTIMB from the adaptive model corrector 122 are added by an adder 160. Also in this instance, a value obtained by addition of the first correction coefficient DKO2OP(k) and the second correction coefficient KTIMB is inputted to the predictor 102 and the identifier 106. Accordingly, effects similar to those achieved by the air fuel ratio controlling section 100 according to the present embodiment can be achieved.

Figure 14:
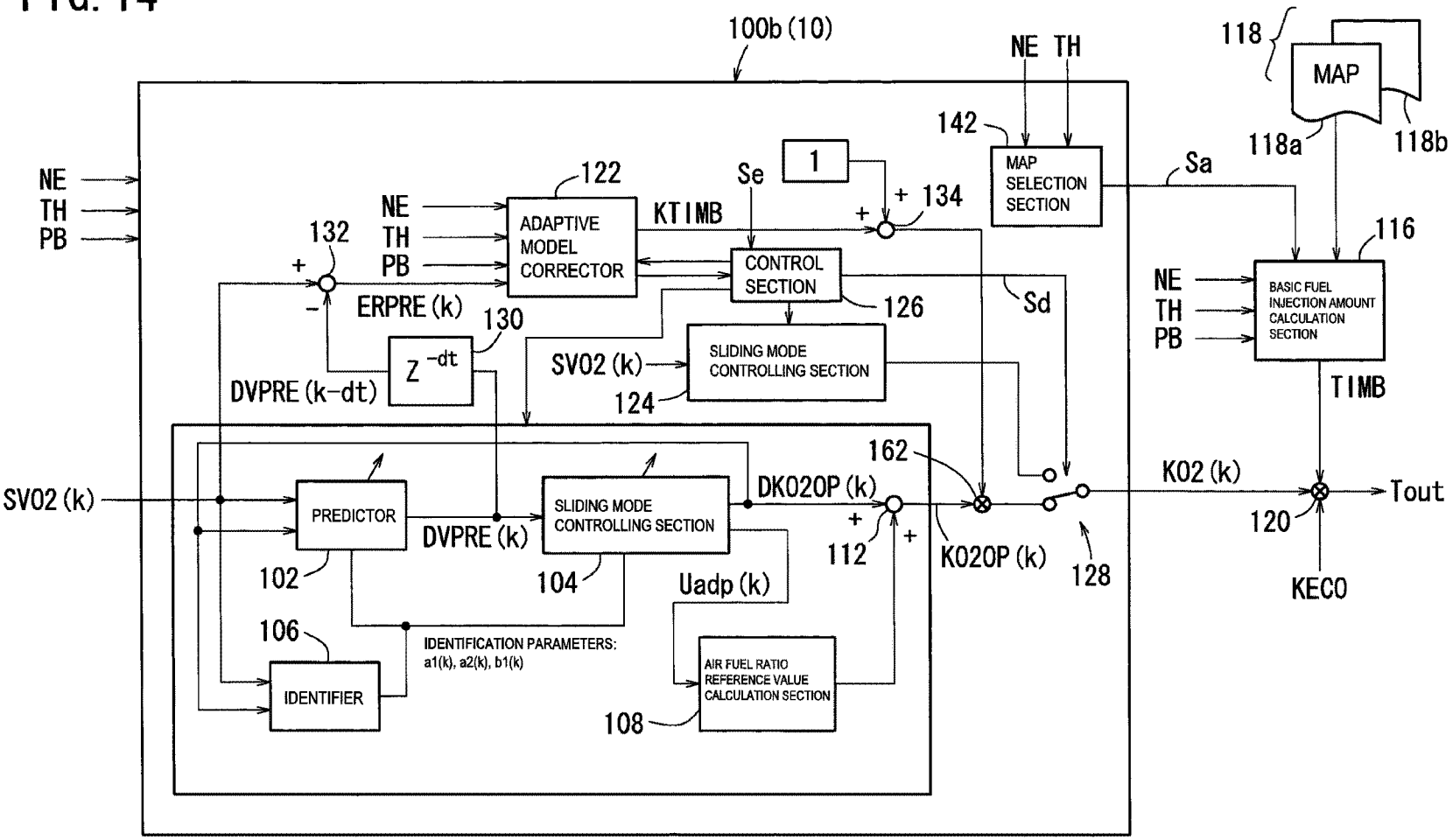
FIG. 14 is a controlling block diagram showing a configuration of an air fuel ratio controlling section according to a second modification.

Although the air fuel ratio controlling section 100*b* according to the second modification has a substantially similar configuration to that of the air fuel ratio controlling section 100 according to the present embodiment as shown in FIG. 14, it is different in that the second correction coefficient KTIMB is not reflected on the predictor 102 and the identifier 106 but an output from the adder 112 (value (KO2OP(k)) obtained by addition of the first correction coefficient DKO2OP(k) from the first sliding mode controlling section 104 and the air fuel ratio reference value from the air fuel ratio reference value calculation section 108) and an output from the adder 134 (value obtained by adding 1 to the second correction coefficient KTIMB) are multiplied by a multiplier 162 to calculate a target air fuel ratio KO2(k). In this instance, since the second correction coefficient KTIMB is reflected on the output of the basic fuel injection amount calculation section 116, effects similar to those achieved by the air fuel ratio controlling section 100 according to the present embodiment can be achieved.

Figure 15:
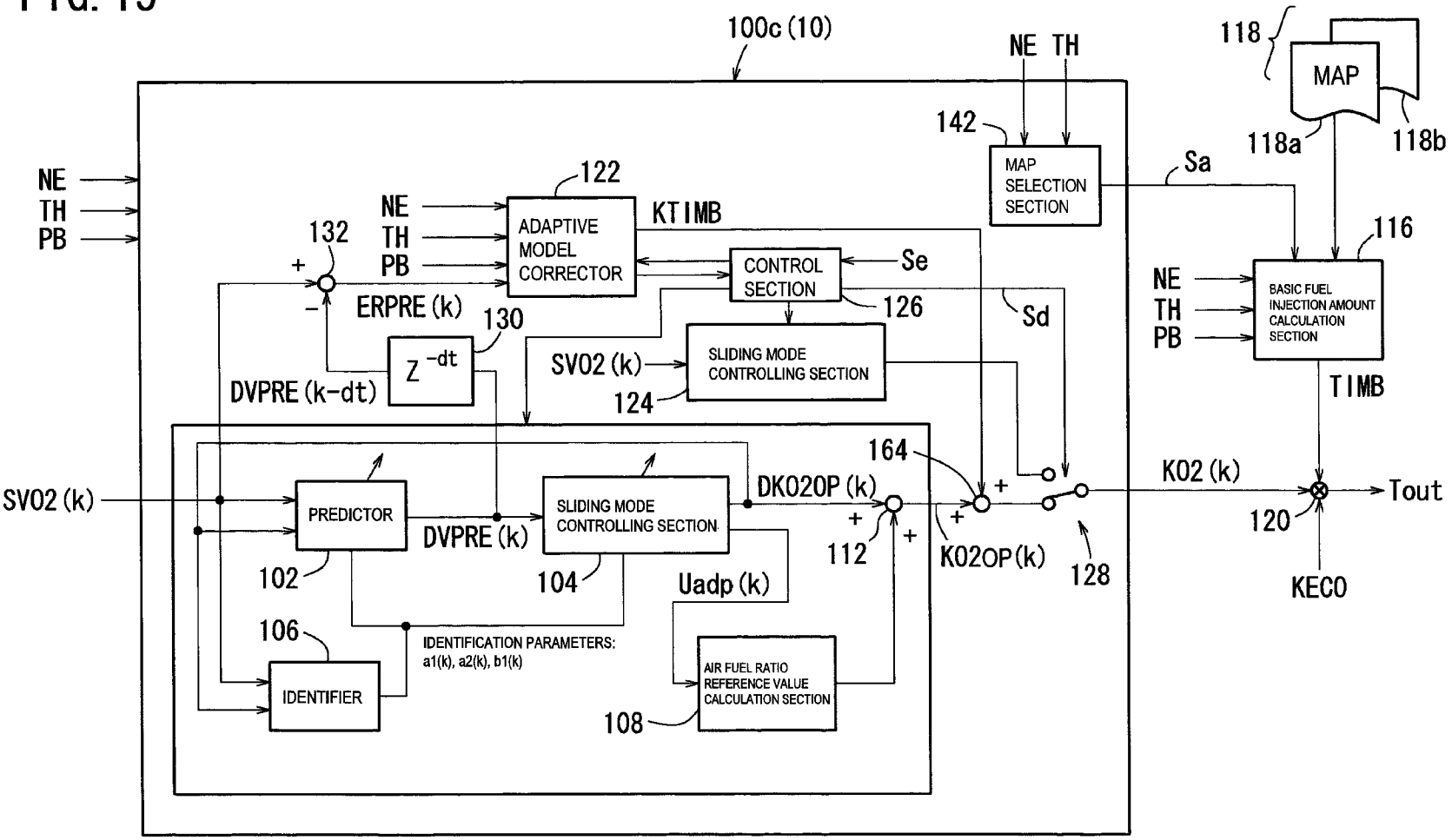
FIG. 15 is a controlling block diagram showing a configuration of an air fuel ratio controlling section according to a third modification.

Although the air fuel ratio controlling section 100*c* according to the third modification has a substantially similar configuration to that of the air fuel ratio controlling section 100*b* according to the second modification as shown in FIG. 15, it is different in that the output KO2OP(k) from the adder 112 and the second correction coefficient KTIMB from the adaptive model corrector 122 are added by an adder 164 to calculate a target air fuel ratio KO2(k). Also in this instance, since the second correction coefficient KTIMB is reflected on the output of the basic fuel injection amount calculation section 116, effects similar to those achieved by the air fuel ratio controlling section 100 according to the present embodiment can be achieved.

Figure 16:
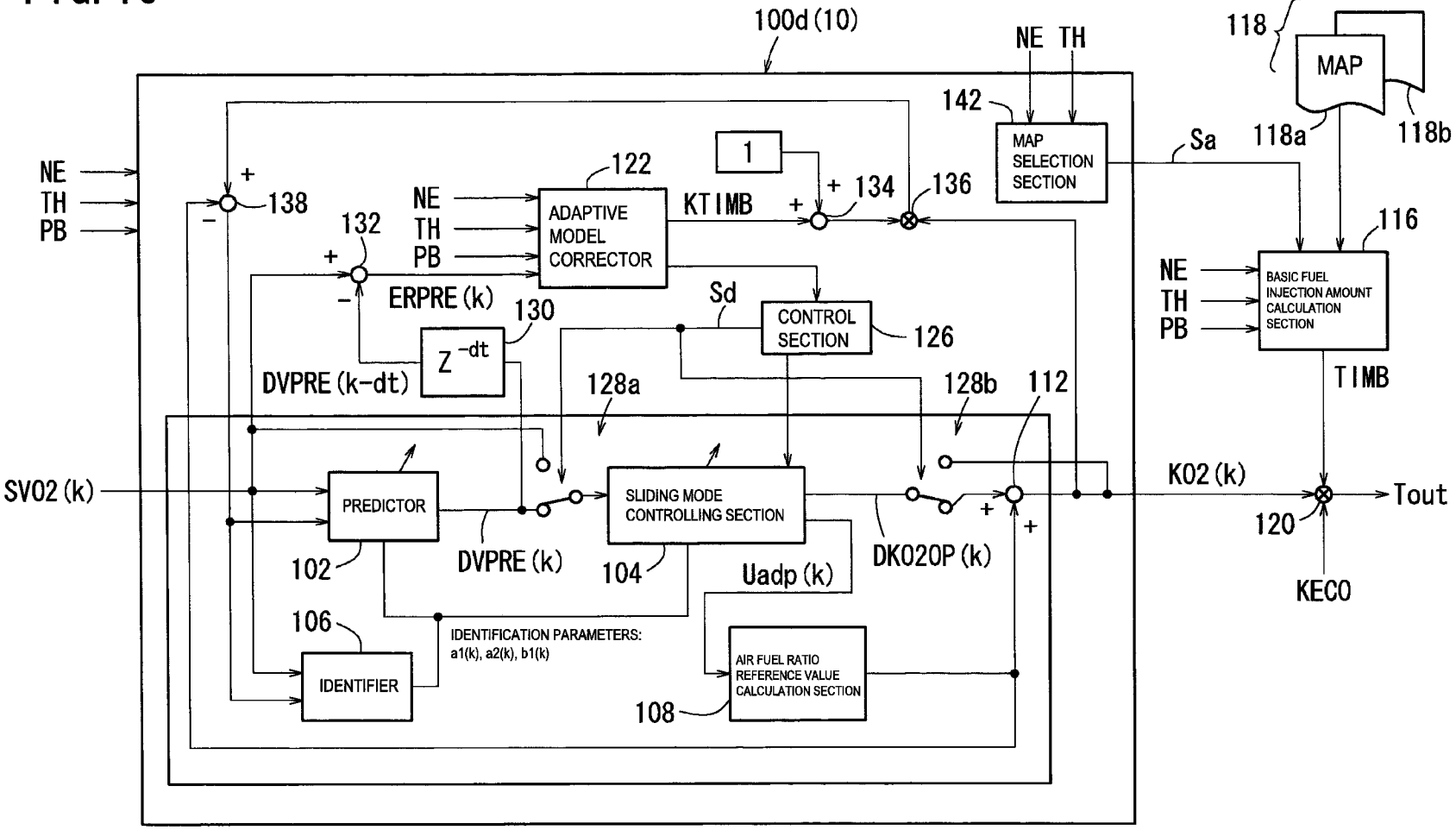
FIG. 16 is a controlling block diagram showing a configuration of an air fuel ratio controlling section according to a fourth modification.

Although the air fuel ratio controlling section 100*d* according to the fourth modification has a substantially similar configuration to that of the air fuel ratio controlling section 100 according to the present embodiment as shown in FIG. 16, a first changeover section 128*a* is installed between the predictor 102 and the first sliding mode controlling section 104, and a second changeover section 128*b* is installed on the output side of the first sliding mode controlling section 104. Normally, the predictor 102 is selected by the first changeover section 128*a*, and an output to the adder 112 is selected by the second changeover section 128*b*. Consequently, since the predicted air fuel ratio DVPRE(k) from the predictor 102 is inputted to the first sliding mode controlling section 104, the first correction coefficient DKO2OP(k) from the first sliding mode controlling section 104 is added to the air fuel ratio reference value by the adder 112 and outputted as a target air fuel ratio KO2(k). On the other hand, if a changeover instruction signal Sd is outputted from the control section 126, then the first changeover section 128*a* selects an input of the actual air fuel ratio SVO2(k) and the second changeover section 128*b* selects an output to the multiplier 120. Consequently, the first sliding mode controlling section 104 carries out feedback so that the error between the actual air fuel ratio (SVO2) and a target value set in advance (for example, a fixed value representative of a stoichiometric region) may be reduced to zero. An output from the first sliding mode controlling section 104 is supplied to the multiplier 120 through the second changeover section 128*b*. Accordingly, also in this fourth modification, effects similar to those achieved by the air fuel ratio controlling section 100 according to the present embodiment can be achieved. Particularly with the fourth modification, the second sliding mode controlling section 124 can be omitted, and simplification in configuration can be anticipated.

Figure 17:
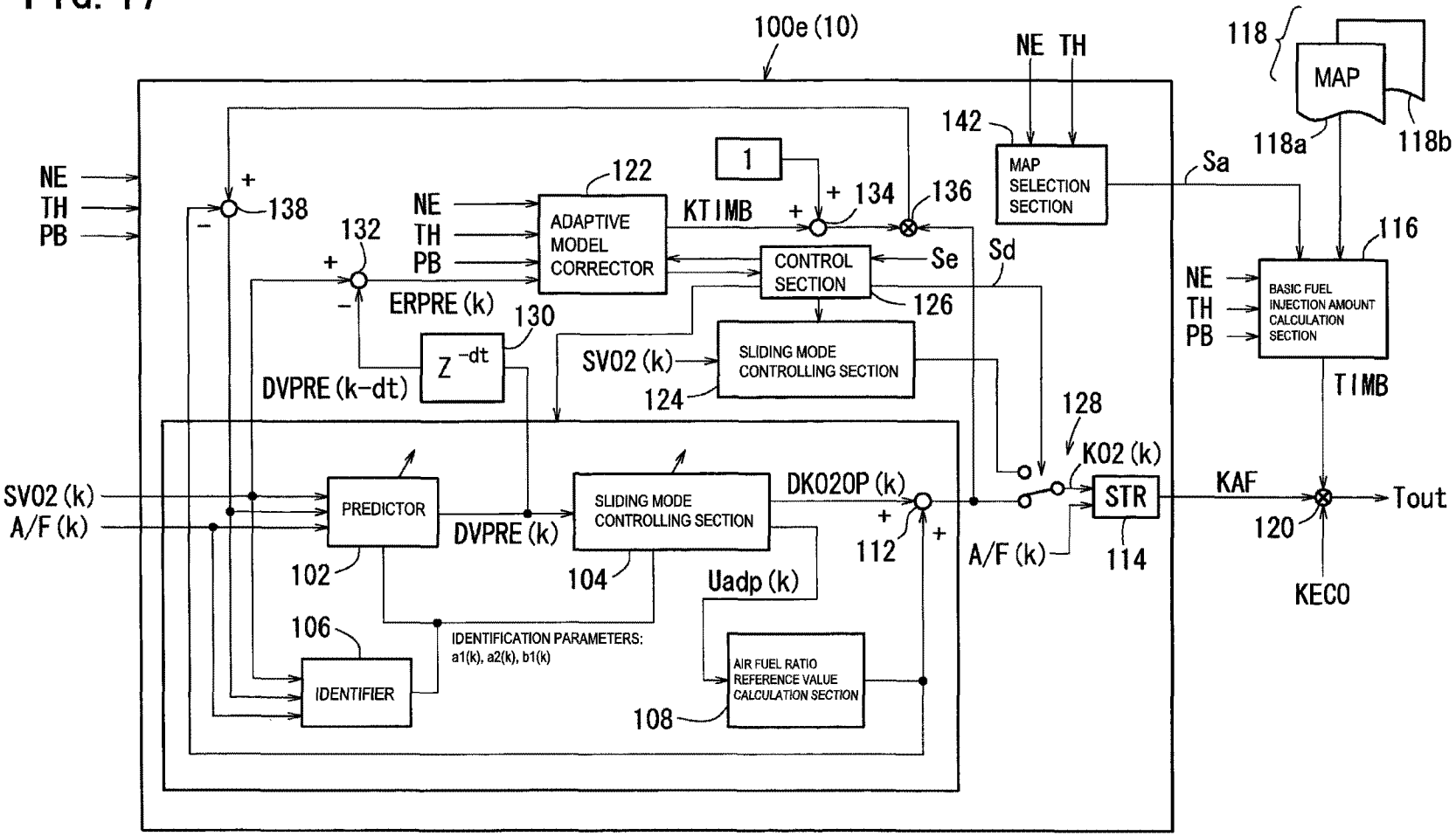
FIG. 17 is a controlling block diagram showing a configuration of an air fuel ratio controlling section according to a fifth modification.

Although the air fuel ratio controlling section 100*e* according to the fifth modification has a substantially similar configuration to that of the air fuel ratio controlling section 100 according to the present embodiment as shown in FIG. 17, it is different in that the LAF sensor 110 is installed on the upstream side of the catalytic apparatus 50 such that the detected air fuel ratio A/F(k) from the LAF sensor 110 is utilized. In this instance, the adaptive controlling section 114 is installed between the changeover section 128 and the multiplier 120.

By utilizing the LAF sensor 110, quick elimination of deterioration of the prediction accuracy arising from insufficiency in accuracy of the basic fuel injection map can be achieved. Naturally, in the air fuel ratio controlling section 100 according to the present embodiment and the air fuel ratio controlling section 100*a* according to the first modification to the air fuel ratio controlling section 100*d* according to fourth modification, since the first correction coefficient DKO2OP(k) from the first sliding mode controlling section 104 and the second correction coefficient KTIMB from the adaptive model corrector 122 are inputted in a superposed state to the predictor 102 and the identifier 106, deterioration of the prediction accuracy can be eliminated quickly. However, by utilizing the LAF sensor 110, quick elimination of deterioration of the prediction accuracy arising from insufficiency in accuracy of the basic fuel injection map 118 can be achieved.

The air fuel ratio controlling section 100 according to the present embodiment and the various modifications described above can be applied not only to air fuel ratio control of an engine but also to a control system wherein the transport delay time from control inputting to outputting is long and it is necessary to configure the predictor 102.

It is to be noted that the air fuel ratio controlling apparatus according to the present invention is not limited to the embodiment described above but can naturally have various configurations without departing from the subject matter of the present invention.

DESCRIPTION OF REFERENCE SYMBOLS

10 . . . Air fuel ratio controlling apparatus
12 . . . Motorcycle
28 . . . Engine
30 . . . Intake pipe
32 . . . Exhaust pipe
38 . . . Throttle valve
40 . . . Fuel injection valve
44 . . . Throttle sensor
48 . . . PB sensor
50 . . . Catalytic apparatus
52 . . . Oxygen sensor
62 . . . ECU
100 . . . Air fuel ratio controlling apparatus
102 . . . Predictor
104 . . . First sliding mode controlling section
106 . . . Identifier
108 . . . Air fuel ratio reference value calculation section
110 . . . LAF sensor
116 . . . Basic fuel injection amount calculation section
118 . . . Basic fuel injection map
118*a* . . . First basic fuel injection map
118*b* . . . Second basic fuel injection map
122 . . . Adaptive model corrector
124 . . . Second sliding mode controlling section
126 . . . Control section
128 . . . Changeover section
140 . . . Selecting map
142 . . . Map selection section
144 . . . Filter processing section
146 . . . Prediction accuracy decision section
148*a* . . . First correction amount arithmetic operation section
148*b* . . . Second correction amount arithmetic operation section
150*a* . . . First correction coefficient arithmetic operation section
150*b* . . . Second correction coefficient arithmetic operation section
152 . . . Weighting section
154 . . . Sliding mode controlling section

The invention claimed is:

1. An engine control system, comprising:

an oxygen sensor provided on a downstream side of a catalyst disposed in an exhaust pipe of an engine and configured to detect an air fuel ratio;

a fuel injection valve; and an electronic control unit, wherein the electronic control unit is configured to determine a fuel injection amount for the engine based on parameters of an engine speed, a throttle opening, and an intake air pressure, predict an air fuel ratio on the downstream side of the catalyst, determine a first correction coefficient with respect to the fuel injection amount based on the predicted air fuel ratio, calculate the predicted air fuel ratio at least based on an actual air fuel ratio from the oxygen sensor and a history of the first correction coefficient, determine a deviation between the actual air fuel ratio and a time-delayed predicted air fuel ratio corresponding to the actual air fuel ratio as a prediction error, calculate a second correction coefficient based on the engine speed, the throttle opening, the intake air pressure, and the prediction error.

superpose the second correction coefficient on the first correction coefficient and reduce the prediction error to zero, determine prediction accuracy based on the prediction error, temporarily stop processing at a stage at which deterioration of the prediction accuracy is decided, shorten a starting period of the electronic control unit during the stopping, determine a correction air fuel ratio by superposing the second correction coefficient with a target air fuel ratio, determine a difference between an air fuel ratio reference value and the correction air fuel ratio, determine the target air fuel ratio by adding the first correction coefficient with the air fuel ratio reference value, determine an environmental correction coefficient at least from parameters of an engine water temperature, an intake air temperature, and an atmospheric pressure, correct the fuel injection amount with the target air fuel ratio and the environmental correction coefficient, output the corrected fuel injection amount as a fuel injection time period, and control an injection of fuel of the fuel injection valve according to the fuel injection time period, wherein the predicted air fuel ratio is determined with the difference of the air fuel ratio reference value and the correction air fuel ratio, and the actual air fuel ratio.

2. The engine control system according to claim 1, wherein, at a stage at which deterioration of the prediction accuracy is decided by said electronic control unit, feedback is carried out so that an error between the actual air fuel ratio and a target value set in advance may be reduced to zero.

3. The engine control system according to claim 1, wherein, at a stage at which it is decided by the electronic control unit that the prediction accuracy is assured, said electronic control unit returns the starting period of said electronic control unit to the original period, and cancels the temporary stopping of said electronic control unit.

4. The engine control system according to claim 2, wherein the electronic control unit is further configured to exclusively carry out feedback so that an error between the actual air fuel ratio and a target value set in advance may be reduced to zero.

5. The engine control system according to claim 3, wherein said electronic control unit is configured to carry out feedback of the first correction coefficient so that an error of the predicted air fuel ratio (DVPRE) may be reduced to zero, and wherein said electronic control unit is configured to return the starting period to the original period, cancel the temporary stopping of said electronic control unit, and to reset a parameter of an identifier for identifying a parameter of said electronic control unit to an initial value.

6. The engine control system according to claim 1, wherein the electronic control unit is further configured to decide prediction accuracy based on the prediction error, and wherein at a stage at which the prediction accuracy is deteriorated, said electronic control unit is configured to carry out feedback so that an error between the actual air fuel ratio and a target value set in advance may be reduced to zero.

7. The engine control system according to claim 1, wherein the electronic control unit is configured to temporarily stop processing for a time set in advance based on an input of a signal indicating that an air fuel ratio feedback condition is satisfied, and to shorten a starting period of said electronic control unit during the stopping.

8. The engine control system according to claim 7, wherein, based on the input of the signal indicating that the air fuel ratio feedback condition is satisfied, feedback is carried out so that an error between the actual air fuel ratio and a target value set in advance may be reduced to zero.

9. The engine control system according to claim 7, wherein, at a stage at which time set in advance elapses, said electronic control unit returns the starting period of said electronic control unit to the original period, and cancels the temporary stopping of said electronic control unit.

10. The engine control system according to claim 1, wherein said electronic control unit is also configured to carry out feedback for time set in advance based on an input of a signal indicating that an air fuel ratio feedback condition is satisfied so that an error between the actual air fuel ratio and a target value set in advance may be reduced to zero.

11. The engine control system according to claim 1, wherein said electronic control unit is configured to carry out feedback of the first correction coefficient so that an error of the predicted air fuel ratio may be reduced to zero, and wherein said electronic control unit is configured to temporarily stop the controlling operation, and to temporarily stop an identifier for identifying a parameter of said electronic control unit.

12. The engine control system according to claim 1, wherein said electronic control unit includes a first basic fuel injection map based on the engine speed and the throttle opening, and a second basic fuel injection map based on the engine speed and the intake air pressure, wherein said electronic control unit is further configured to select a basic fuel injection map to be used based on the engine speed and the throttle opening from between said first basic fuel injection map and said second basic fuel injection map, and wherein where said first basic fuel injection map is selected by said electronic control unit, said electronic control unit is configured to carry out feedback of a prediction error correction amount so that the prediction error on which a weight component based on the engine speed and the throttle opening is reflected may be reduced to zero in a fixed time period, and to calculate the second correction coefficient based on the prediction error correction amount at a predetermined timing.

13. The engine control system according to claim 1, wherein said electronic control unit includes a first basic fuel injection map based on the engine speed and the throttle opening, and a second basic fuel injection map based on the engine speed and the intake air pressure, wherein said electronic control unit is further configured to select a basic fuel injection map to be used based on the engine speed and the throttle opening from between said first basic fuel injection map and said second basic fuel injection map, and wherein where said second basic fuel injection map is selected by said electronic control unit, said electronic control unit is configured to carry out feedback of a prediction error correction amount so that the prediction error on which a weight component based on the engine speed and the intake air pressure is reflected may be reduced to zero within a fixed time period, and to calculate the second correction coefficient based on the prediction error correction amount at a predetermined timing.

14. An air fuel ratio controlling apparatus, comprising:

an electronic control unit, wherein the electronic control unit is configured to injection amount for an engine based on parameters of an engine speed, a throttle opening, and an intake air pressure, predict an air fuel ratio on a downstream side of a catalyst, determine a first correction coefficient with respect to the fuel injection amount based on the predicted air fuel ratio, calculate the predicted air fuel ratio at least based on an actual air fuel ratio from an oxygen sensor and a history of the first correction coefficient, determine a deviation between the actual air fuel ratio and a time-delayed predicted air fuel ratio corresponding to the actual air fuel ratio as a prediction error, calculate a second correction coefficient based on the engine speed, the throttle opening, the intake air pressure, and the prediction error, superpose the second correction coefficient on the first correction coefficient and reduce the prediction error to zero, determine prediction accuracy based on the prediction error, temporarily stop processing at a stage at which deterioration of the prediction accuracy is decided, shorten a starting period of the electronic control unit during the stopping, determine a correction air fuel ratio by superposing the second correction coefficient with a target air fuel ratio, determine a difference between an air fuel ratio reference value and the correction air fuel ratio, determine the target air fuel ratio by adding the first correction coefficient with the air fuel ratio reference value, determine an environmental correction coefficient at least from parameters temperature, an intake air temperature, and an atmospheric pressure, correct the fuel injection amount with the target air fuel ratio and the environmental correction coefficient, output the corrected fuel injection amount as a fuel injection time period, and control an injection of fuel of a fuel injection valve according to the fuel injection time period, wherein the predicted air fuel ratio is determined with the difference of the air fuel ratio reference value and the correction air fuel ratio, and the actual air fuel ratio, wherein said fuel injection amount includes a first fuel injection amount based on the engine speed and the throttle opening, and a second fuel injection amount based on the engine speed and the intake air pressure, wherein said electronic control unit is further configured to select a basic fuel injection map to be used based on the engine speed and the throttle opening from between a first basic fuel injection map and a second basic fuel injection map, wherein said first fuel injection amount is selected from said first basic fuel injection map by said electronic control unit, wherein said electronic control unit is further configured to carry out feedback of a prediction error correction amount so that the prediction error on which a weight component based on the engine speed and the throttle opening is reflected may be reduced to zero in a fixed time period, and to calculate the second correction coefficient based on the prediction error correction amount at a predetermined timing, and wherein said electronic control unit is further configured to:

superpose a first weight component on which sensitivity with respect to an air fuel ratio is reflected, a second weight component on which a variation of a value of said first basic fuel injection map with respect to a variation of the engine speed and the throttle opening is reflected, and third weight components corresponding to a plurality of regions obtained by segmenting said first basic fuel injection map based on the engine speed and the throttle opening, on the prediction error within the fixed time period to obtain correction model errors corresponding to the plural regions;

carry out feedback of the prediction error correction amounts corresponding to the plural regions so that such correction model errors corresponding to the plural regions may be reduced to zero in the fixed time period; and superpose the third weight components corresponding to the plural regions on the prediction error correction amounts corresponding to the plural regions at the predetermined timing to calculate correction coefficients corresponding to the plural regions and to add all of the correction coefficients to calculate the second correction coefficient.

15. An air fuel ratio controlling apparatus, comprising:

an electronic control unit, wherein the electronic control unit is configured to determine a fuel injection amount for an engine based on parameters of an engine speed, a throttle opening, and an intake air pressure, predict an air fuel ratio on a downstream side of a catalyst, determine a first correction coefficient with respect to the fuel injection amount based on the predicted air fuel ratio, calculate the predicted air fuel ratio at least based on an actual air fuel ratio from an oxygen sensor and a history of the first correction coefficient, determine a deviation between the actual air fuel ratio and a time-delayed predicted air fuel ratio corresponding to the actual air fuel ratio as a prediction error, calculate a second correction coefficient based on the engine speed, the throttle opening, the intake air pressure, and the prediction error, superpose the second correction coefficient on the first correction coefficient and reduce the prediction error to zero, determine prediction accuracy based on the prediction error, temporarily stop processing at a stage at which deterioration of the prediction accuracy is decided, shorten a starting period of the electronic control unit during the stopping, determine a correction air fuel ratio by superposing the second correction coefficient with a target air fuel ratio, determine a difference between an air fuel ratio reference value and the correction air fuel ratio, determine the target air fuel ratio by adding the first correction coefficient with the air fuel ratio reference value, determine an environmental correction coefficient at least from parameters of an engine water temperature, an intake air temperature, and an atmospheric pressure, correct the fuel injection amount with the target air fuel ratio and the environmental correction coefficient, output the corrected fuel injection amount as a fuel injection time period, and control an injection of fuel of a fuel injection valve according to the fuel injection time period, wherein the predicted air fuel ratio is determined with the difference of the air fuel ratio reference value and the correction air fuel ratio, and the actual air fuel ratio, wherein said fuel injection amount includes a first fuel injection amount based on the engine speed and the throttle opening, and a second fuel injection amount based on the engine speed and the intake air pressure, wherein said electronic control unit is further configured to select a basic fuel injection map to be used based on the engine speed and the throttle opening from between a first basic fuel injection map and a second basic fuel injection map, wherein said second fuel injection amount is selected from said second basic fuel injection may by said electronic control unit, wherein said electronic control unit is further configured to carry out feedback of a prediction error correction amount so that the prediction error on which a weight component based on the engine speed and the intake air pressure is reflected may be reduced to zero within a fixed time period, and to calculate the second correction coefficient based on the prediction error correction amount at a predetermined timing, wherein said electronic control unit is further configured to superpose a first weight component on which sensitivity with respect to an air fuel ratio of said oxygen sensor is reflected, a second weight component on which a variation of a value of said second basic fuel injection map with respect to a variation of the engine speed and the intake air pressure is reflected, and third weight component corresponding to a plurality of regions obtained by segmenting the second basic fuel injection map based on the engine speed and the intake air pressure, on the prediction error within the fixed time period to obtain correction model errors corresponding to the plural regions, wherein the electronic control unit is further configured to carry out feedback of the prediction error correction amounts corresponding to the plural regions so that such correction model errors corresponding to the plural regions may be reduced to zero in the fixed time period, and wherein the electronic control unit is further configured to superpose the third weight components corresponding to the plural regions on the prediction error correction amounts corresponding to the plural regions at the predetermined timing to calculate correction coefficients corresponding to the plural regions and to add all of the correction coefficients to calculate the second correction coefficient.

16. An air fuel ratio controlling apparatus, comprising:

a means for detecting an air fuel ratio provided on a downstream side of a catalyst disposed in an exhaust pipe of an engine; and an electronic control means for:

determining a fuel injection amount for the engine based on parameters of an engine speed, a throttle opening, and an intake air pressure, predicting an air fuel ratio on the downstream side of the catalyst, determining a first correction coefficient with respect to the fuel injection amount based on the predicted air fuel ratio, calculating the predicted air fuel ratio at least based on an actual air fuel ratio from the means for detecting the air fuel ratio and a history of the first correction coefficient, determining a deviation between the actual air fuel ratio and a time-delayed predicted air fuel ratio corresponding to the actual air fuel ratio as a prediction error, calculating a second correction coefficient based on the engine speed, the throttle opening, the intake air pressure, and the prediction error, superposing the second correction coefficient on the first correction coefficient and reduce the prediction error to zero, determining prediction accuracy based on the prediction error, temporarily stopping processing at a stage at which deterioration of the prediction accuracy is decided, shortening a starting period of the electronic control unit during the stopping, determining a correction air fuel ratio by superposing the second correction coefficient with a target air fuel ratio, determining a difference between an air fuel ratio reference value and the correction air fuel ratio determining the target air fuel ratio by adding the first correction coefficient with the air fuel ratio reference value, determining an environmental correction coefficient at least from parameters of an engine water temperature, an intake air temperature, and an atmospheric pressure, correcting the fuel injection amount with the target air fuel ratio and the environmental correction coefficient, outputting the corrected fuel injection amount as a fuel injection time period, and controlling an injection of fuel of a fuel injection valve according to the fuel injection time period, controlling the determination of the first correction coefficient, the receipt of the deviation between the actual air fuel ratio and the time-delayed predicted air fuel ratio, and the superposing of the second correction coefficient on the first correction coefficient, deciding prediction accuracy based on the prediction error, and stopping processing at a stage at which deterioration of the prediction accuracy is decided, and for shortening a starting period of the electronic control means during the stopping, and temporarily stopping processing at a stage at which deterioration of the prediction accuracy is decided by the electronic control means, and for shortening a starting period of the electronic control means during the stopping, wherein the predicted air fuel ratio is determined with the difference of the air fuel value and the correction air fuel ratio, and the actual air fuel ratio.

17. The air fuel ratio controlling apparatus according to claim 16, wherein, at a stage at which deterioration of the prediction accuracy is decided by the electronic control means, feedback is carried out so that an error between the actual air fuel ratio and a target value set in advance may be reduced to zero without using the air fuel ratio prediction means.

* * * * *